US009314940B2

(12) United States Patent
Garfinkel et al.

(10) Patent No.: US 9,314,940 B2
(45) Date of Patent: Apr. 19, 2016

(54) AUTOMATED CONCRETE STRUCTURAL MEMBER FABRICATION METHOD

(71) Applicants: Erik Garfinkel, Palo Alto, CA (US); John R. MacMillan, Portola Valley, CA (US)

(72) Inventors: Erik Garfinkel, Palo Alto, CA (US); John R. MacMillan, Portola Valley, CA (US)

( * ) Notice: Subject to any disclaimer, the term of this patent is extended or adjusted under 35 U.S.C. 154(b) by 0 days.

(21) Appl. No.: 14/724,816

(22) Filed: May 29, 2015

(65) Prior Publication Data

US 2015/0290835 A1 Oct. 15, 2015

Related U.S. Application Data

(63) Continuation of application No. 12/957,700, filed on Dec. 1, 2010, now Pat. No. 9,186,813.

(51) Int. Cl.

| | |
|---|---|
| ***B28B 7/10*** | (2006.01) |
| ***B28B 7/00*** | (2006.01) |
| ***B28B 7/18*** | (2006.01) |
| ***B28B 7/28*** | (2006.01) |
| ***B28B 13/02*** | (2006.01) |
| ***B28B 15/00*** | (2006.01) |
| ***B28B 7/22*** | (2006.01) |
| ***E04C 1/00*** | (2006.01) |
| ***E04C 2/04*** | (2006.01) |
| ***B28C 1/00*** | (2006.01) |

(52) U.S. Cl.

CPC ..... *B28B 7/10* (2013.01); *B28B 7/0044* (2013.01); *B28B 7/183* (2013.01); *B28B 7/22* (2013.01); *B28B 7/285* (2013.01); *B28B 13/026* (2013.01); *B28B 15/00* (2013.01); *B28C 1/003* (2013.01); *E04C 1/00* (2013.01); *E04C 2/04* (2013.01)

(58) Field of Classification Search

CPC ..... B28B 7/0044; B28B 7/183; B28B 7/285

See application file for complete search history.

(56) References Cited

U.S. PATENT DOCUMENTS

| | | | | |
|---|---|---|---|---|
| 1,542,021 | A * | 6/1925 | Akers | B28B 7/02 249/101 |
| 2,582,161 | A * | 1/1952 | Randall | B28B 7/0044 249/101 |
| 5,840,348 | A * | 11/1998 | Heiligman | B30B 11/005 425/407 |
| 6,605,240 | B2 * | 8/2003 | Hambelton | E01D 21/00 249/170 |
| 2004/0123556 | A1 * | 7/2004 | Karanikas | B28B 7/0079 52/782.1 |

* cited by examiner

*Primary Examiner* — James Sanders

(74) *Attorney, Agent, or Firm* — Larry B. Guernsey; Patent Law Office of Larry Guernsey

(57) ABSTRACT

A method of fabrication for precast concrete structural members, including providing an automated concrete structural member fabrication system, including at least one casting machine having a self-releasing mold which includes side walls and end dams which are pivotally movable from an open position to a closed position, and a bottom casting surface, where the bottom casting surface, the side walls, and the end dams surround a cavity when the side walls and the end dams are in closed position, and a removable mold core subsystem which is removably positionable within the cavity; moving the mold sides, the mold end dams and the bottom casting surfaces to a closed position; positioning the mold core subsystem within the cavity; filling the cavity with wet concrete; idling the casting machine until the wet concrete has achieved initial set to form an initial set concrete block; automatically releasing the self-releasing mold from the initial set concrete block; and removing the initial set concrete block from the casting machine.

9 Claims, 29 Drawing Sheets

AUTOMATED CONCRETE STRUCTURAL MEMBER FABRICATION METHOD

The present application is a continuation of and claims priority to currently pending application Ser. No. 12/957,700, filed Dec. 1, 2010 entitled AUTOMATED CONCRETE STRUCTURAL MEMBER FABRICATION SYSTEM, APPARATUS AND METHOD, by the present inventors.

TECHNICAL FIELD

The present invention relates generally to the field of construction, and more particularly to apparatus for manufacturing precast blocks for the construction of walls and other structures.

BACKGROUND ART

Precast concrete structural members are becoming increasingly known and used to create buildings or other structures. These precast structural members include blocks, foundation elements and partial wall units and incorporate a wide range of precast block designs that vary from the simple to the very complex. The most elementary precast block designs are those used in basic, concrete masonry, such as the well-known "cinder block". While concrete masonry units (CMUs) may be designed for a variety of applications, they can result in structures that are structurally inferior to those created with larger, reinforced concrete units. As a result, larger precast blocks are being used, but generally the larger the precast block, the more difficult the fabrication process.

One example of larger-scale precast units is found in U.S. Pat. No. 5,678,903, by one of the present inventors, which discloses a modular precast wall system with mortar joints. The precast wall units discussed in this patent are of much larger size and complexity than the simple CMUs previously used. As one might expect, the sheer size and weight of larger-scale precast units present unique problems in their manufacture. If a system for their production is to be efficient, there must be a system for casting the blocks, removing the cast blocks from the casting molds and conveying them for shipment which does not require gigantic casting and transportation equipment, and which is not heavily labor intensive.

Thus there is a need for an apparatus and method of manufacture for larger-scale precast concrete blocks which, is substantially automated, easy to use and clean, integrates casting and transportation functions, and is of moderate scale.

DISCLOSURE OF INVENTION

Accordingly, it is an object of the present invention to provide a flexible system for manufacturing precast structural block units from concrete.

Another object of the present invention is to provide a modular system for creating precast units of various dimensions.

A further object of the present invention is to minimize the manual labor requirements, and its attendant expense, in producing precast structural members.

Still another object of the present invention is to provide an automated system which permits drying and hardening of the block units in a different location from the concrete pouring area.

Yet another object of the present invention is to provide modular mold components which may be readily substituted, for cleaning, repair and special configurations.

A further object of the present invention is to provide a system containing multiple self-releasing molds which are sequentially supplied by a concrete delivery system so that the system is in constant production of precast structural blocks.

Briefly, one preferred embodiment of the present invention is a casting machine for fabrication of precast concrete structural members which includes a self-releasing mold. The self-releasing mold includes side walls which are movable from an open position to a closed position and end dams which are movable from an open position to a closed position. The self-releasing mold also includes a bottom casting surface, where the bottom casting surface, side walls, and end dams surround a cavity configured to contain wet concrete. A mold core subsystem, including a top core and a bottom core, is also included. The mold core subsystem is automatically positioned in the cavity and helps form the shape and structure of the finished precast blocks. Mixed concrete is poured into the cavity around the mold core subsystem when the self-releasing mold is in closed position. The concrete is allowed to set to an initial set state, where it is rigid enough to be self-supporting, but is not yet cured. The side walls, and end dams are automatically movable to the open position when the concrete has solidified, and the top core and bottom core are retracted automatically so that the precast concrete structural member is automatically released from the self-releasing mold.

The casting machines are modular in nature, meaning that any number of them can be included in a precast modular system. The modular system includes a concrete mixing system in which concrete is mixed, and poured into a concrete hopper assembly. This concrete hopper assembly is part of a concrete delivery subsystem which also includes a rail system by which the concrete hopper assembly can travel to each of the numerous casting machines in turn, and fill each cavity of each self-releasing mold. A block transport subsystem is also included by which the initial set blocks leave the casting machines by conveyer mechanisms, and are delivered to one or more curing ovens. After initial curing, the blocks are conveyed to a stocking area for final curing and eventual shipment.

An advantage of the present invention is that it provides an efficient and streamlined system for manufacture of modular precast blocks.

Another advantage of the present invention is that it provides an apparatus of moderate size and complexity for casting modular precast blocks.

And another advantage of the present invention is that it provides an apparatus which includes a conveying system for the cast modular precast blocks A further advantage of the present invention is that it provides an apparatus which includes a simple means of removing the cast modular blocks from the molding device.

A yet further advantage is that the present invention incorporates the casting, removal and conveying of the modular precast blocks in a single system.

Yet another advantage of the present invention is that the system is expandable to accommodate multiple casting machines, which can be served by a concrete delivery system.

Another advantage of the present invention is that the system can be automated so that very little human labor is required, and consequently the cost of production is reduced.

A further advantage of the present invention is that it can be operated as an automated system by which mixed concrete is introduced at the input and finished precast blocks can be collected from the output.

A yet further advantage of the present invention is that the blocks produced are created by a wet cast concrete method, which are stronger than those made by dry compaction processes, such as conventional cinder blocks.

Another advantage is that by producing larger blocks, there are fewer joints and cracks in a comparable expanse of completed wall than in a wall made of smaller blocks, and therefore a tighter, stronger wall is produced.

Additional advantages of the present invention over walls produced by the "tilt up" method, (whereby a wall section is poured on site into a horizontal mold, and is then tilted up vertically to be mounted as a wall section), are that a smooth flat surface is not required on the site, good weather is not required, wall height is not limited to a single section, and it is easier to integrate the blocks of the present invention with structural steel members with floor and ceiling members.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1A:
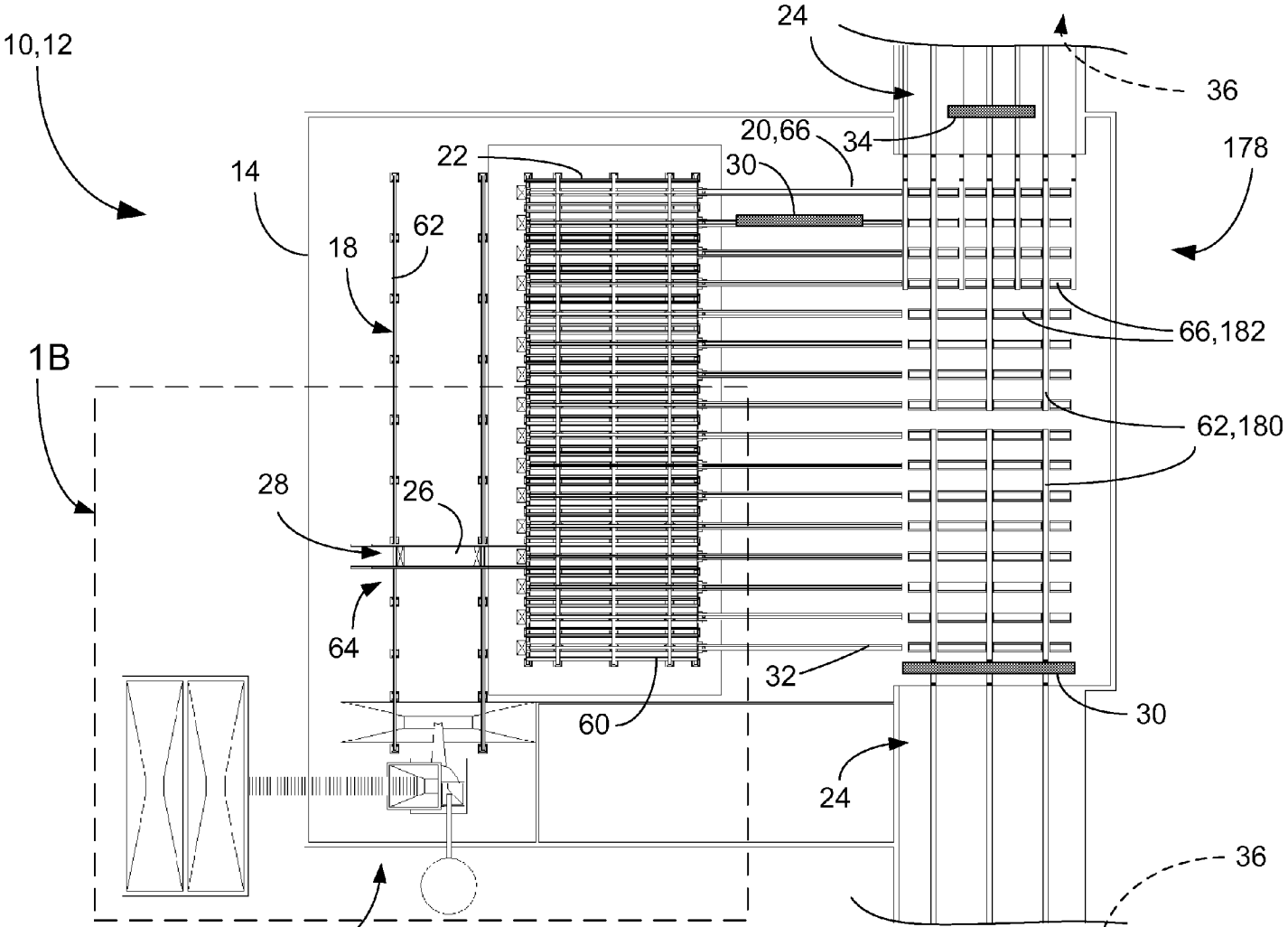
FIG. 1A shows an overhead plan view of a production plant which embodies the system of fabrication of the present invention.

A presently preferred embodiment of the present invention is a system for manufacture of precast concrete structural members. An overhead plan view of the preferred embodiment is the fabrication system illustrated in FIGS. 1A and B and the other figures of the drawings and is designated by the general reference character 10. The system of the present invention 10 provides an automated system for the fabrication of precast modular blocks for building construction, which is highly efficient and allows the production of much greater numbers of precast modular blocks of a larger size then is possible by use of prior casting equipment and methods.

Figure 2:
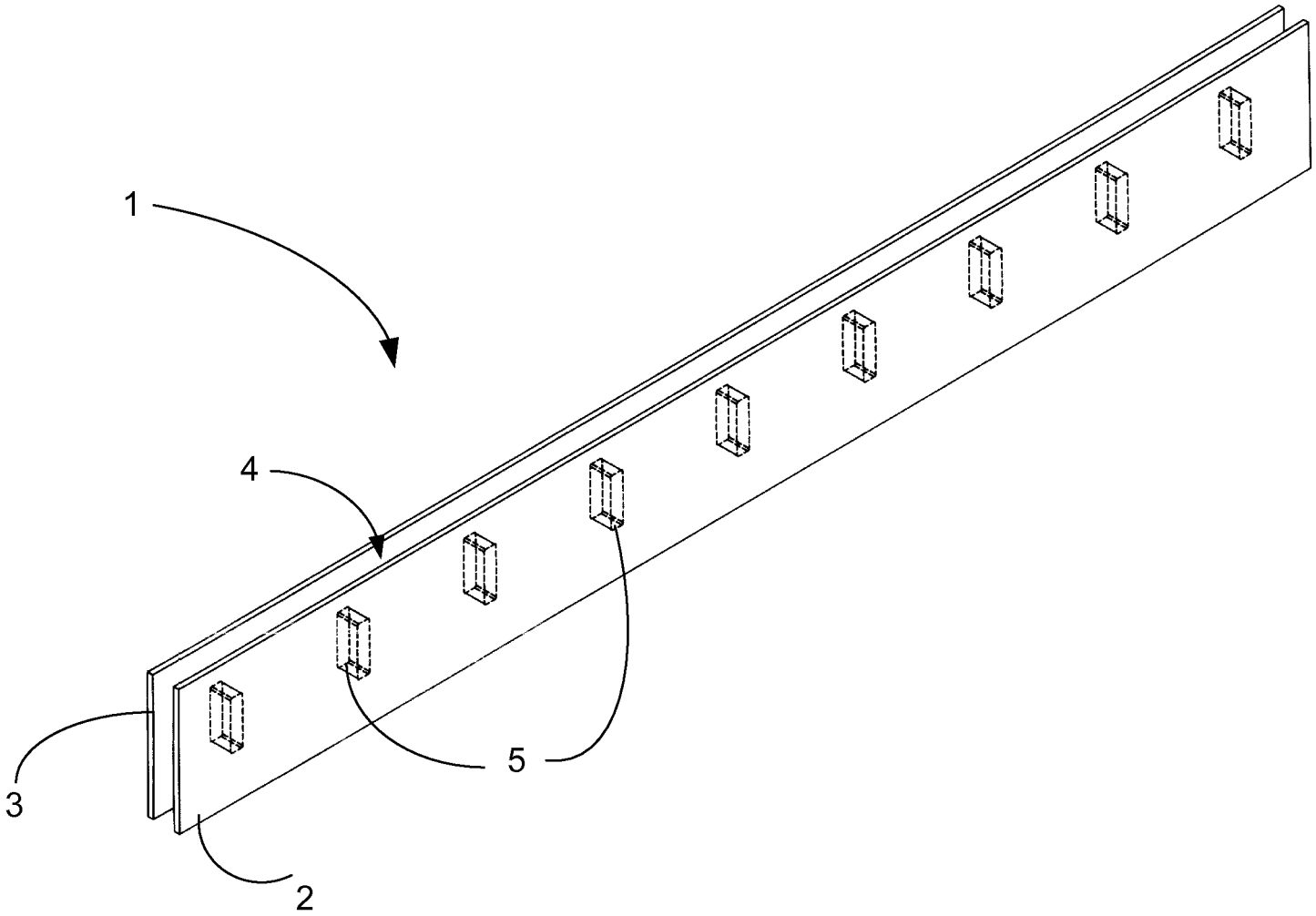
FIG. 2 illustrates a block unit as fabricated by the system of the present invention.
Figure 3:
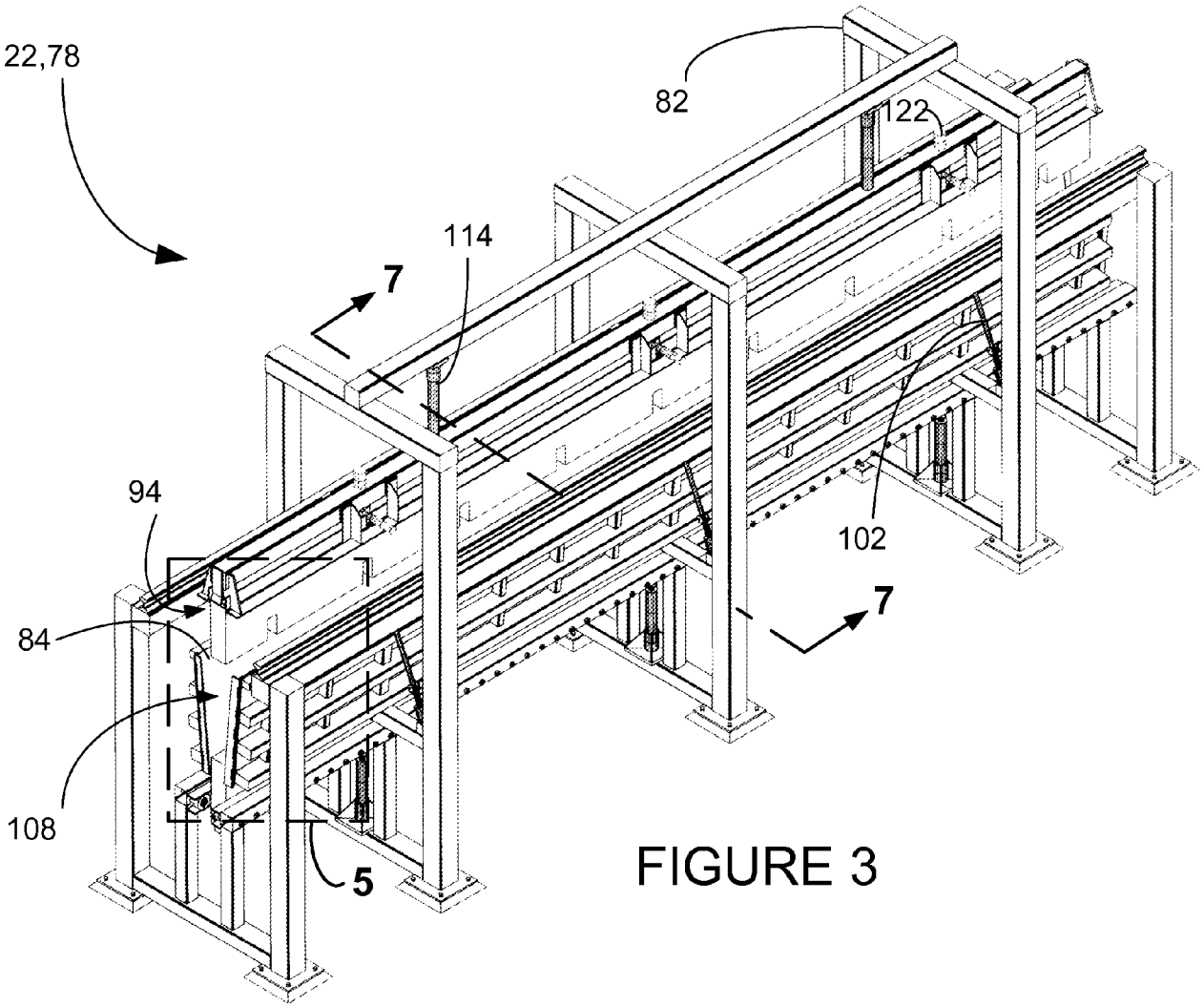
FIG. 3 shows an isometric view of a casting machine of the present invention in open configuration.

The purpose of the fabrication system 10 is to create precast block units of the type illustrated in FIG. 2. The typical precast block unit shown in perspective view in FIG. 2 is designated by the reference number 1. As shown, the block unit 1 is laterally symmetrical and includes a first sidewall 2 and a second sidewall 3, situated on either side of an interior cavity 4. A plurality of laterally spaced crossweb members 5 lie within the transverse interior cavity 4 and connect the first sidewall 2 to the second sidewall 3. The block unit 1 is integrally formed (cast) and does not have any additional binding or connection components.

The blocks 1 are preferably at least partially hollow in order to easily incorporate structural reinforcement members such as rebar or steel lengths. The hollow construction of the block units 1 allows easy integration with other steel structural reinforcements, which may be included in floor and ceiling units.

Returning to FIGS. 1A and B, FIG. 1A shows the precast modular system 10 which includes a plan view of a production plant 12 largely surrounded by a perimeter wall 14. FIG. 1B shows a detail view of the portion of FIG. 1A which is enclosed in the dotted box designated "1B". A concrete mixing subsystem 16 extends beyond a portion of the perimeter wall 14. The plant 12 includes a rail system 18, a block transport system 20, a number of casting machines 22 and at least one curing oven 24, of which two are shown in the figure. As will be discussed below, the concrete mixing subsystem 16 mixes concrete 26, which is then deposited in a concrete hopper assembly 28. The concrete hopper assembly 28 moves along the rail system 18, until it aligns with one of the casting machines 22. It delivers the concrete 26 into the casting machine 22, which produces an initial set concrete block, which is rigid enough to stand on its own, but still requires curing. It is moved by conveyer belts 32 of the block transport system 20 to one of the curing ovens 24, where it preferably remains at a temperature in the range of 140-180 degrees for 8 to 24 hours. It then emerges as an initial cure block 34, where it is moved to a stocking area which may also serve as a final curing area 36 (not shown) where it preferably remains for an additional 28 days to complete its curing process, and is ready to ship as a completed block 1 (see FIG. 2). The stocking area can be any conventional storage area, and as such, is not illustrated here.

Figure 1B:
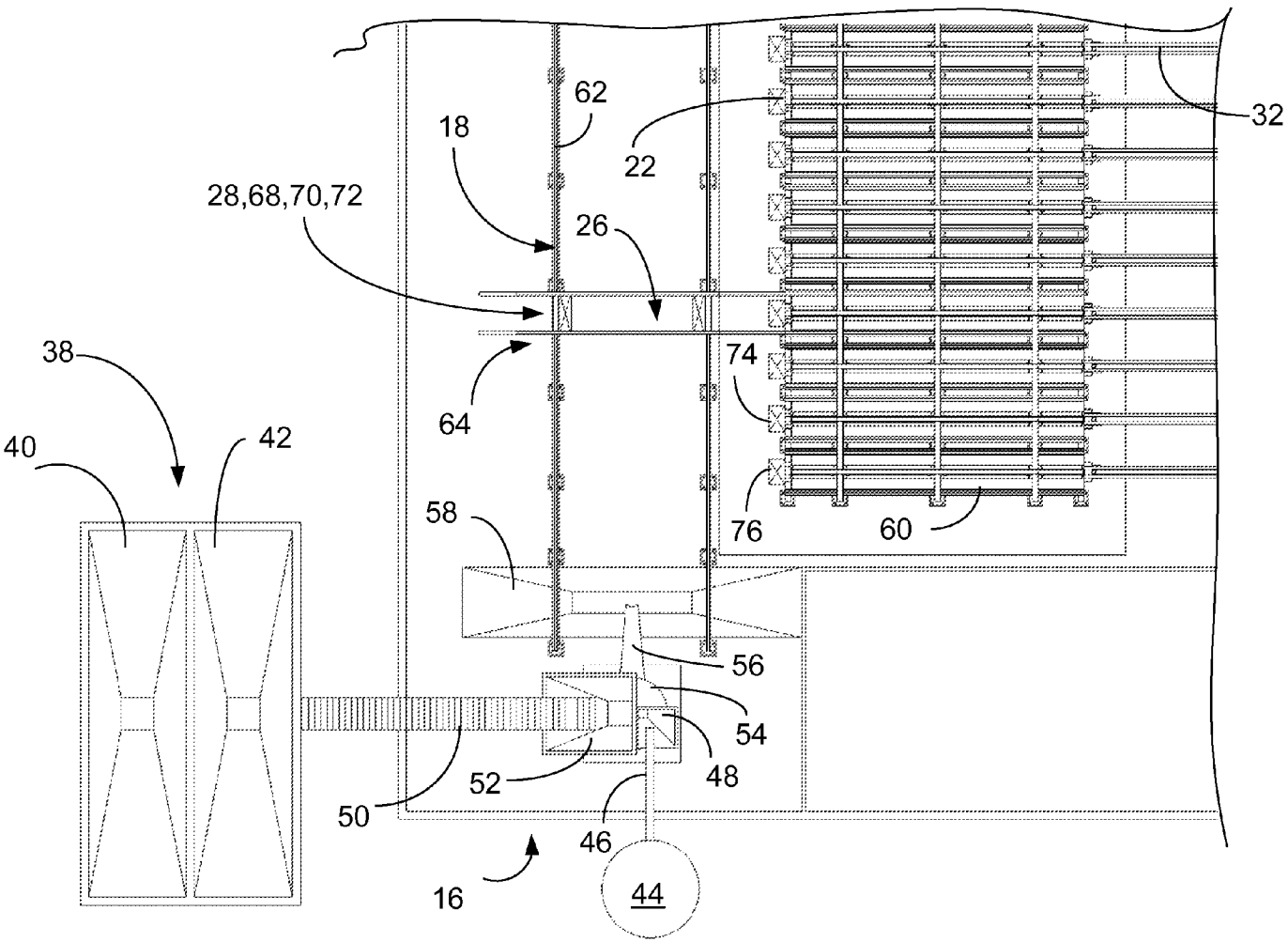
FIG. 1B shows an detail of a portion of FIG. 1A which is enclosed in box labeled 1B in FIG. 1A.

FIG. 1B shows a detail view of the portion of the overall plant 12 which is enclosed in the dashed box 1B of FIG. 1A. Referring now to both FIGS. 1A and 1B, the concrete mixing subsystem 16 includes aggregate bins 38. The aggregate bins 38 include a sand bin 40 and a gravel bin 42. The concrete mixing subsystem 16 also includes a cement silo 44, which is connected by a screw conveyer 46 to a cement hopper 48. Two conveyer belts 50 deliver sand and gravel from the aggregate bins 38 to an aggregate hopper 52 which feeds into a concrete mixer 54. The cement hopper 48 also feeds cement to the concrete mixer 54. There is also a water line (not shown) connecting to the concrete mixer 54. In operation, the conveyer belts 50 deliver sand and gravel from the aggregate bins 38 to the aggregate hopper 52, which includes a scale (not shown) which weighs the incoming aggregate. When a predetermined amount is received, the conveyer belts 50 shut off, and the aggregate is poured into the concrete mixer 54, along with cement from the cement silo 44 through the cement hopper 48, and water. The concrete mixer 54 cycles until a mixed batch of concrete is ready. It is then poured down a chute 56 into the concrete hopper assembly 28, which has been moved into position to receive it, although it is not shown in receiving position in this figure. A hopper wash-out area 58 is shown, which is preferably a 2-3 foot deep depression with a drain in the bottom. This hopper wash-out area 58 can be used to wash out the concrete hopper assembly 28 between concrete deliveries.

Figure 7:
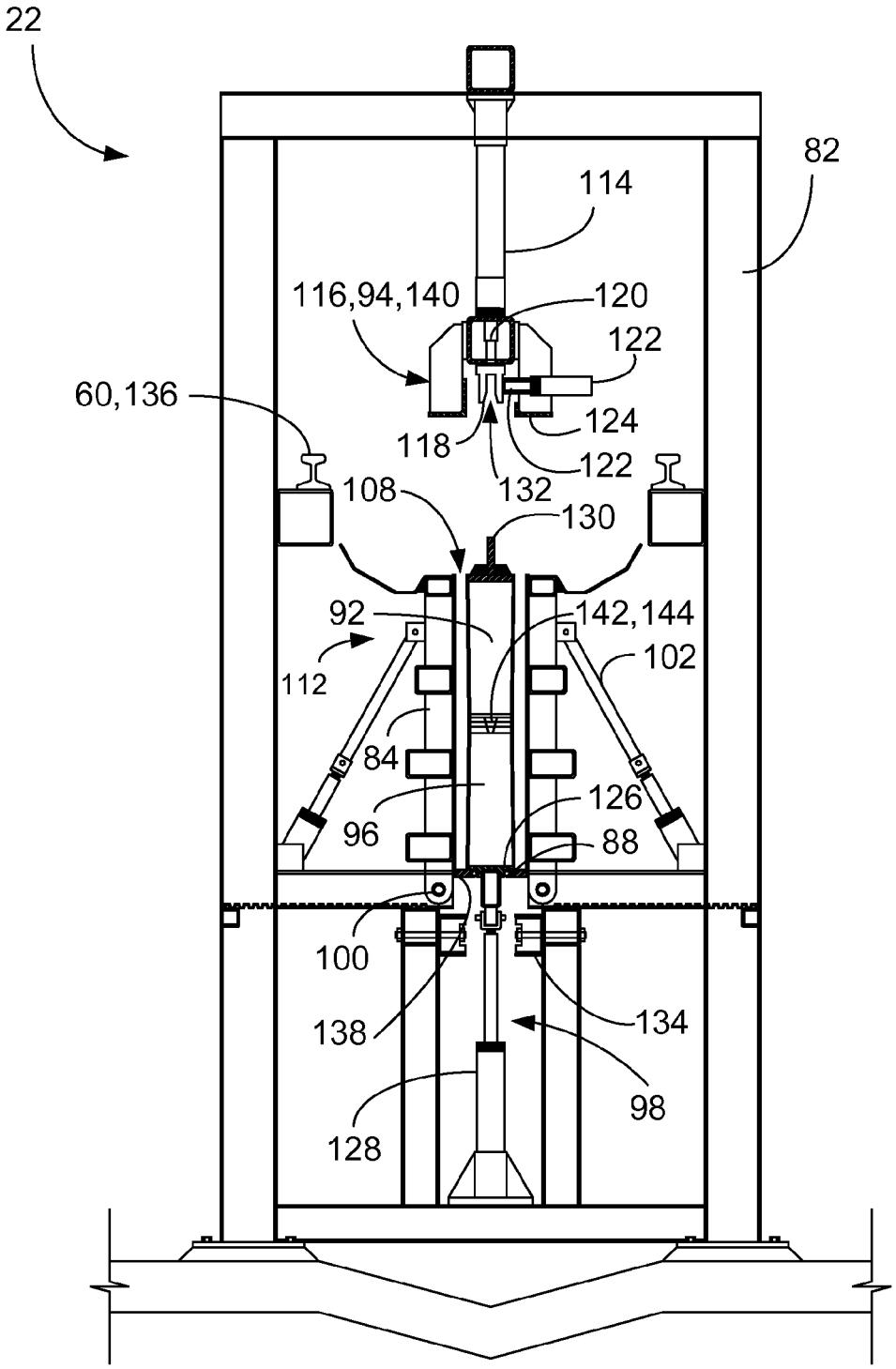
FIG. 7 shows a cross-sectional view of the casting machine of the present invention in view 7 of FIG. 3, showing a first stage of the fabrication process.
Figure 21:
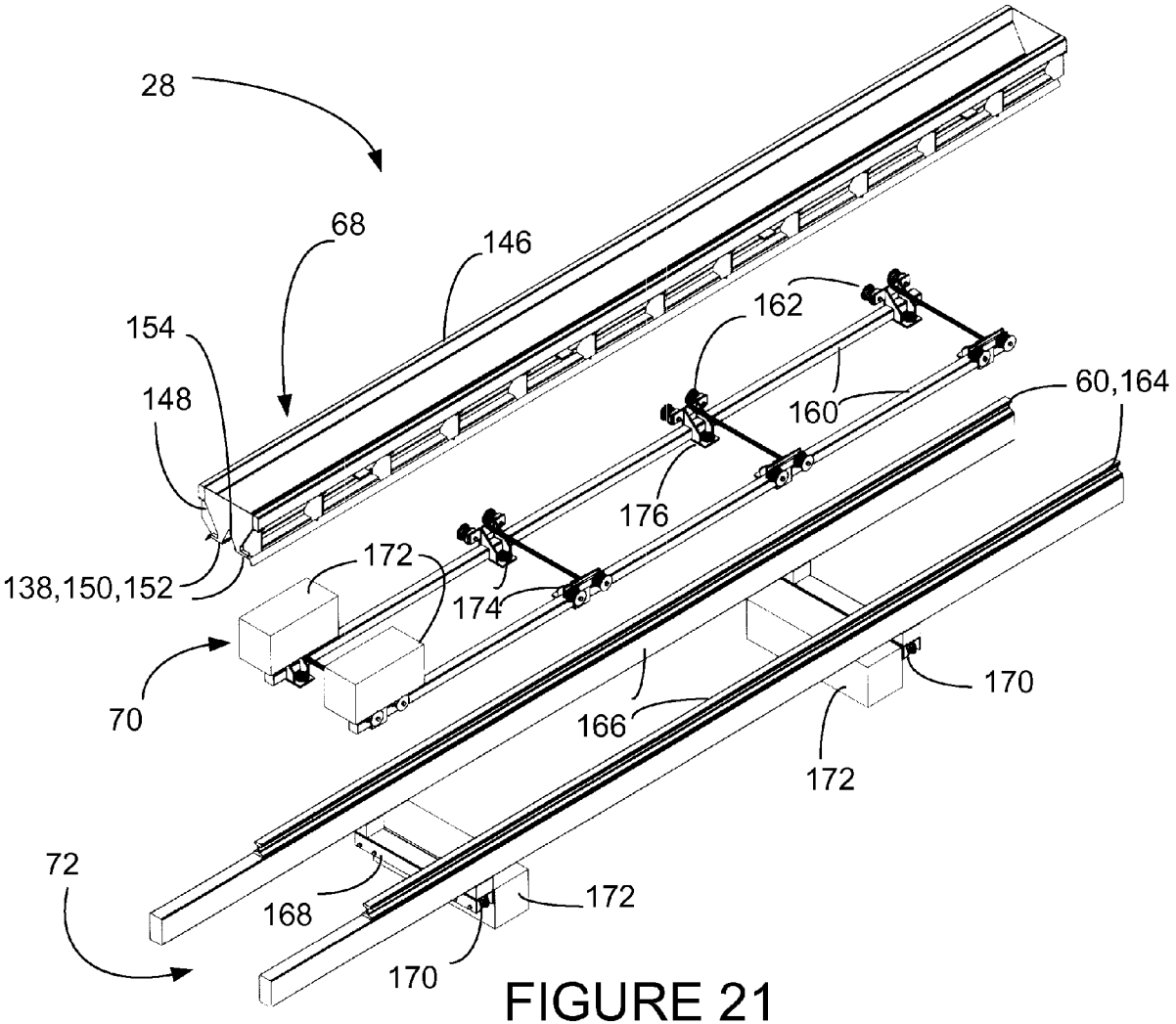
FIG. 21 shows an exploded isometric view of the concrete delivery subsystem of the present invention, including the hopper assembly with hopper carriage and hopper carriage mover of the present invention.

Referring now also to FIGS. 7 and 21, the rail system 18 includes lateral rails 60 and transverse rails 62. The lateral rails 60 include casting machine rails 136, which are included in the casting machines 22 and internal rails 164 included in the concrete hopper assembly 28, as will be discussed below. The concrete hopper assembly 28 moves on the transverse rails 62 to be positioned over the hopper washout area 58, which is under the concrete chute 56 in order to be washed out, and to receive mixed concrete 26. It also moves along the transverse rails 62 to align with one of the multiple casting machines 22, in order to load the casting machine 22 with concrete 26. Thus a concrete delivery system 64 includes the rail system 18 and the concrete hopper assembly 28, and moves the mixed concrete from the concrete mixing system 16 to fill the various casting machines 22 with concrete 26.

The concrete hopper assembly 28 includes at least one concrete hopper 68, a hopper carriage 70, and hopper carriage mover 72. These will be discussed in more detail below, but generally, the concrete hopper 68 contains the mixed concrete 26, the hopper carriage mover 72 generally moves the concrete hopper 68 and hopper carriage 70 in a vertical direction, and the hopper carriage 70 then moves the concrete hopper 68 in a horizontal direction, in the reference plane of FIGS. 1A and B.

When the blocks 1 have achieved at least an initial set stage, where they are rigid enough to be self-supporting, they are ready to emerge from the casting machines 22 and are moved to be cured. The block transport system 20 moves these blocks and the block transport system 20 includes a number of conveying mechanisms, preferably conveyer belts 66, both lateral and transverse in orientation (horizontal and vertically depicted in the FIGS. 1A and B).

It will be understood by those skilled in the art, that other conveying mechanisms rather than belts may be used, such as rollers, ball bearings, etc. Thus the term "conveyer belts 66" shall be used in this document to include all of these possible conveying mechanisms and should not be construed as a limitation.

As illustrated in FIGS. 1A and B and the subsequent illustrations, it may be seen that the overall modular fabrication system 10 for precast block units 1 includes general components which recur modularly. Among those illustrated are a casting machine #1 74, a casting machine #2 76 and so on for as many repetitions as are needed in the overall system. In the preferred embodiment 10 illustrated in FIGS. 1A and B, there are sixteen casting machines shown, with only the first two being provided with reference numbers.

Figure 4:
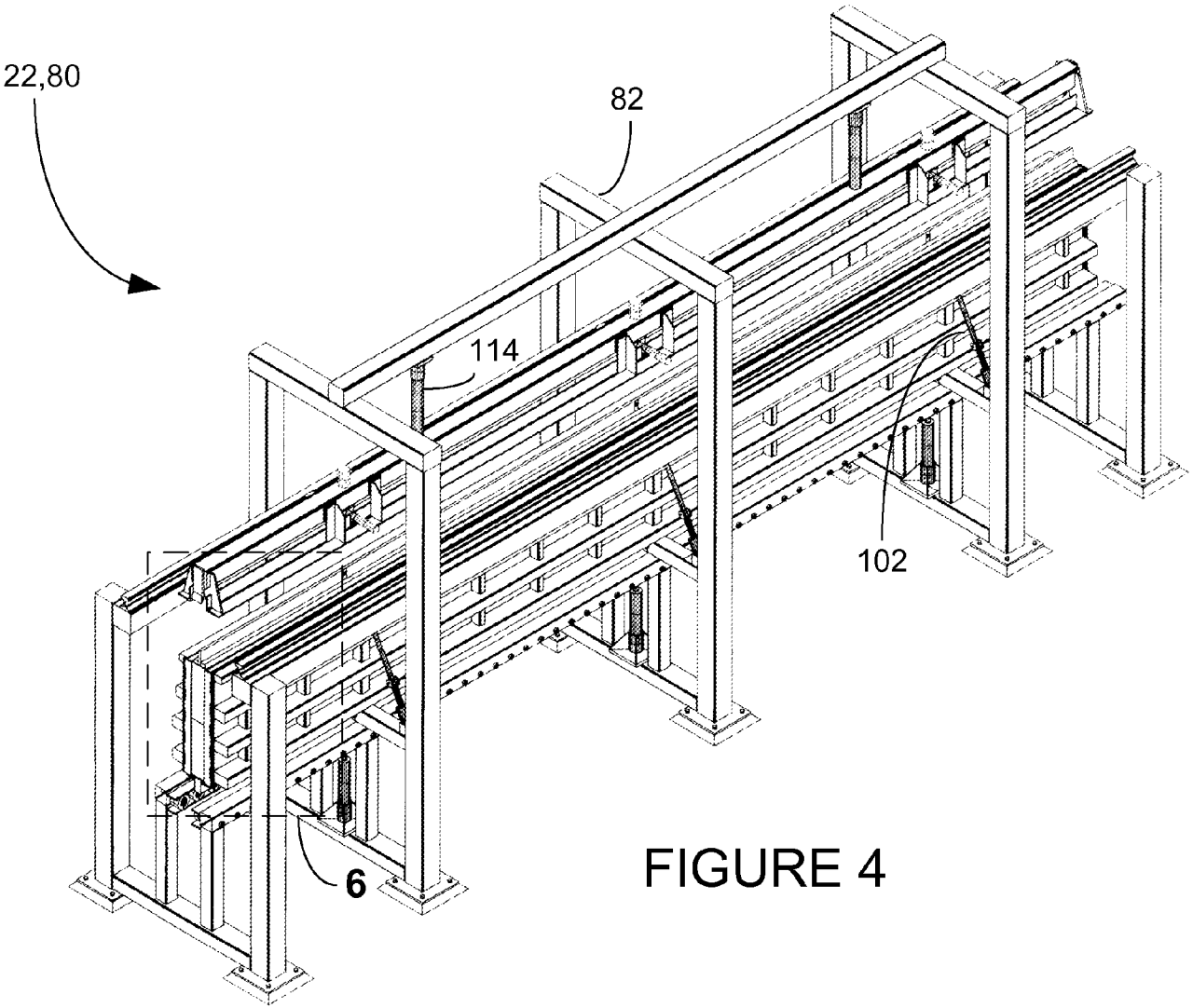
FIG. 4 shows an isometric view of a casting machine of the present invention in closed configuration.
Figure 5:
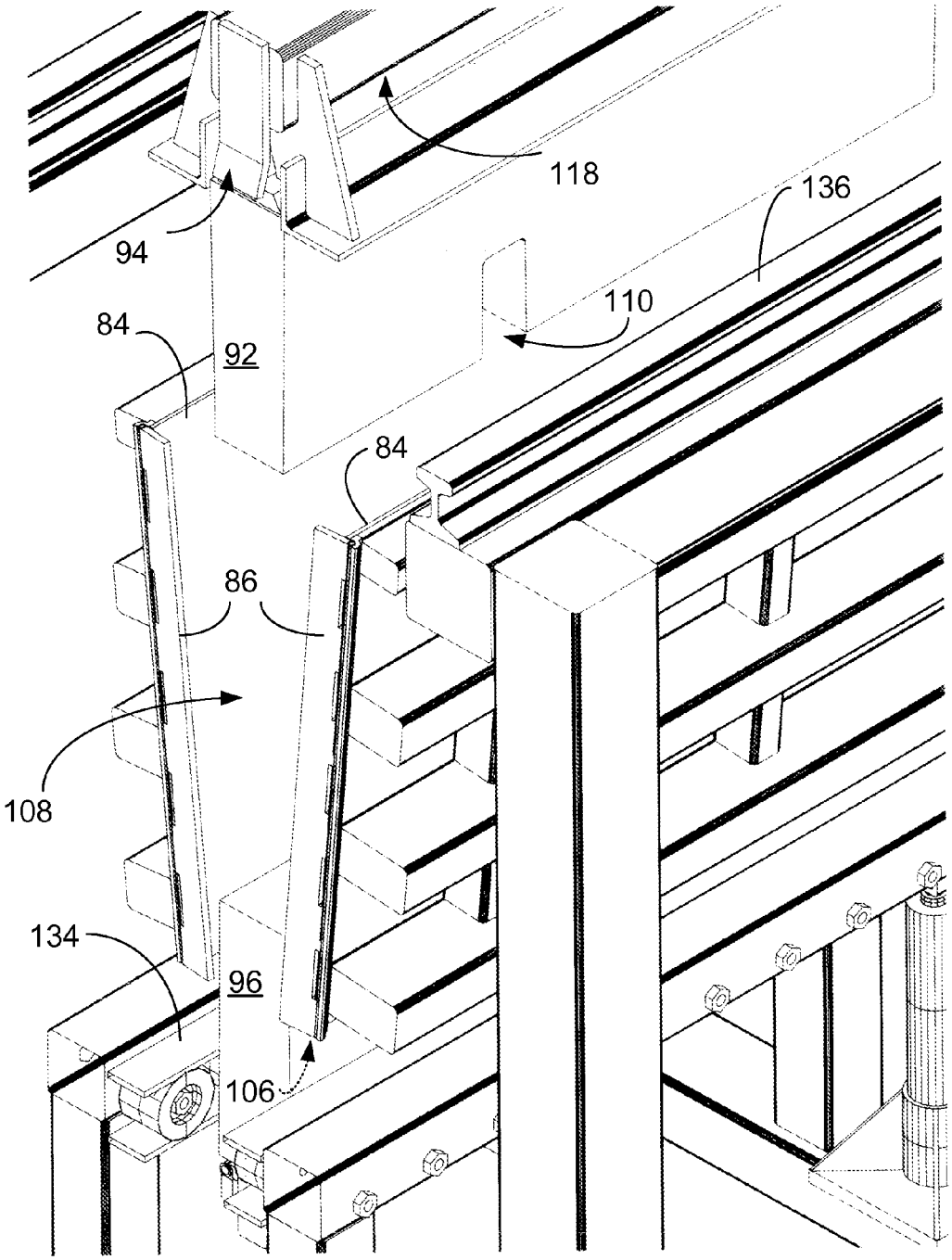
FIG. 5 shows a detail view of a casting machine of the present invention in open configuration taken from detail 5 of FIG. 3.
Figure 6:
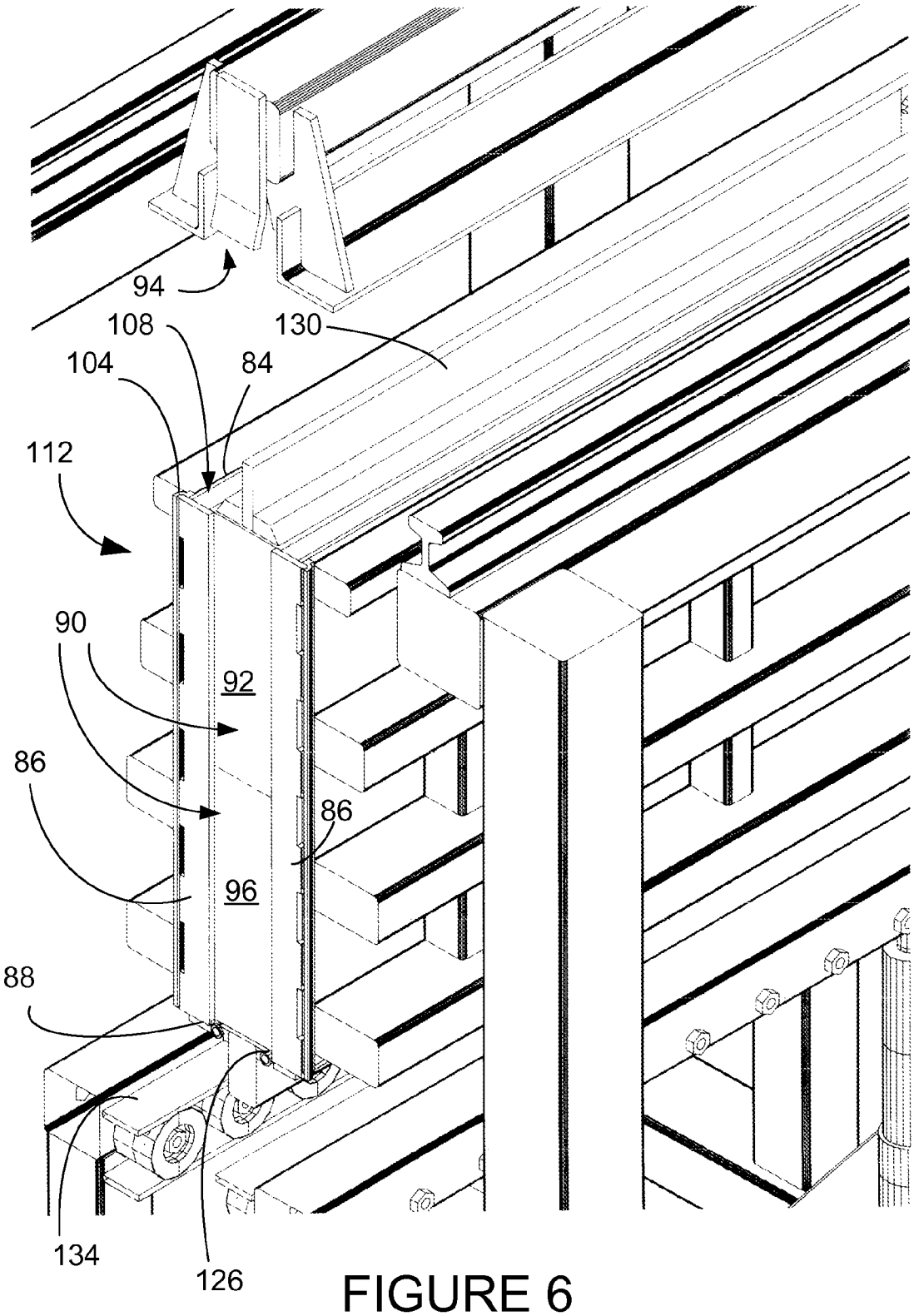
FIG. 6 shows a detail view of a casting machine of the present invention in open configuration taken from detail 6 of FIG. 4.

The details of a representative one of the casting machines 22 is shown in FIGS. 3-6. The casting machine 22 is shown in perspective views in FIGS. 3-4 in first open configuration 78 and then closed configuration 80. Details of the perspective view of the left end of the casting machine 22 are shown in FIGS. 5-6. Additionally, the stages in the operating cycle of the casting machine are shown in a series of cross-sectional views taken initially from line 7-7 of FIG. 3, starting with FIG. 7 and continuing through FIG. 19. FIGS. 7-19, which illustrate the stages of a cycle in the operation of the casting machine 22, as well as FIGS. 3-6 will be referred to generally in the following discussion, as well as specifically and individually below.

The casting machine 22 includes a frame 82, mold sides 84, mold end dams 86, a bottom casting surface 88, and a mold core subsystem 90, which includes a top core 92, a top core placement assembly 94, a bottom core 96 and a bottom core extractor assembly 98. The mold sides 84 are rotationally disposed on side pivots 100, and are moved from the open angled position 78, as in FIG. 3, to the closed upright position 80, as in FIG. 4, by mold side hydraulics 102. The mold end dams 86 are similarly rotationally disposed on end pivots 104, and are moved from the closed upright position to the open angled position by mold end motors 106 (not visible).

When the casting machine 22 is in closed position 80, as in FIGS. 4 and 6, the mold sides 84, mold end dams 86, and bottom casting surface 88 surround a cavity 108 into which the wet concrete will be poured. The top core 92 and bottom core 96 are placed into the cavity 108, and serve to form upper and lower cavities in the block to be formed. As discussed above, the top core 92 and bottom core 96 have transverse channels 110 configured in them so that crossweb members are formed in the block to connect its two sides and provide it with structural strength. The mold sides 84, mold end dams 86, and bottom casting surface 88, as well as the top core 92 and bottom core 96 together form a self-releasing mold 112, which is the form into which the wet concrete will be poured to form the blocks. The mold is termed "self-releasing" as it is able to automatically pull away from the formed blocks without the laborious manual manipulation which is involved in prior art casting machines.

The top core placement assembly 94 is used to place the top core 92 into the cavity 108 before the concrete is poured, and then to extract it from the formed block once it has achieved its initial set. The top core placement assembly 94 includes core lifter hydraulics 114 and a core extractor 116, which has a top core collar 118, collar extractor hydraulics 120, hydraulically moved horizontal retaining pin 122 and collar flange feet 124. The top core placement assembly 94 is designed to engage an attachment bracket 130 on the top surface of the top core 92 which fits into the top core collar 118. The top core collar 118 has a groove 132 into which the attachment bracket 130 fits. The attachment bracket 130 has a number of through holes (not visible) into which the retaining pins 122 pass, thus releasably locking the collar 118 onto the attachment bracket 130 of the top core 92. The top core 92, then can be grossly positioned by the retraction or extension of the core lifter hydraulics 114, or moved more subtly by the collar extractor hydraulics 120. Speaking generally, the core lifter hydraulics 114 are used for lifting the top core 92 and placing it into, or removing it from the cavity 108, while the collar extractor hydraulics 120 are used for finer positioning or to carefully break the top core 92 free from the hardening cement block.

The bottom core 96 is attached to the bottom core extractor assembly 98 which also includes bottom casting surfaces 88, which are rotatably attached by bottom surface pivots 126. The bottom core extractor assembly 98 is raised and lowered by bottom core vertical hydraulics 128.

The casting machine 22 also preferably has a block conveyor mechanism 134, part of the block transport system 20, (see FIGS. 1A and B) which may be rollers or one or more conveyer belts for removing the hardening cast blocks from the casting machine 22. They may then be conveyed to a curing area for further hardening, as will be discussed below.

The casting machine 22 also preferably has a set of casting machine rails 136 for the delivery of the hopper carriage 70, carrying the concrete hopper 68, into the casting machine 22.

The casting machine 22, is thus configured with a mold core subsystem 90, which fills the interior cavity 4 space of the block 1 which is to be cast (see FIG. 2). The mold core subsystem 90 itself has transverse channels 110 (see FIG. 5) which are filled with wet concrete to form the crossweb members 5. It is to be understood that the blocks shown here are for purposes of illustration, and that the casting machine and mold core subsystem of the present invention may be modified in a number of ways to produce blocks of many different structures. The present invention is not to be limited to the production of only the illustrated type or structure of blocks, and many other variations will be obvious to those skilled in the art. For example the blocks may be of many varied lengths and widths, and the casting machines may be configured to produce such varied blocks.

As referred to above, FIGS. 7-19 illustrate the stages of a cycle in the operation of the casting machine 22, and these figures will be referred to generally in the following discussion.

FIG. 7 shows the initial stage in the fabrication cycle of a concrete block, as the casting machine 22 is ready to cast a block. The mold side hydraulics 102 have moved the mold sides 84 to upright position as they pivot on the side pivots 100. Similarly, the mold end dams 86 have moved to closed position as they pivot on the end pivots 104 (see FIGS. 5 and 6). The bottom surface panels 138 of the bottom casting surfaces 88 are rotated to horizontal position on the bottom surface pivots 126. The bottom core extractor assembly 98 has been extended so that the bottom core 96 is positioned within the cavity 108. The top core 92 has been placed in the cavity 108 as well by the core lifter subassembly 140 (see also FIG. 22), which is part of the top core placement assembly 94. The top core placement assembly 94 has been detached from the top core 92 and raised. The top core 92 and bottom core 96 are held in exact alignment by conical pins 142 that project from the top core 92 which are received by matching conical holes 144 in the bottom core 96. At this point, all the casting surfaces have been cleaned and oiled, so that the cast concrete block eventually produced will be released more easily.

Figure 8:
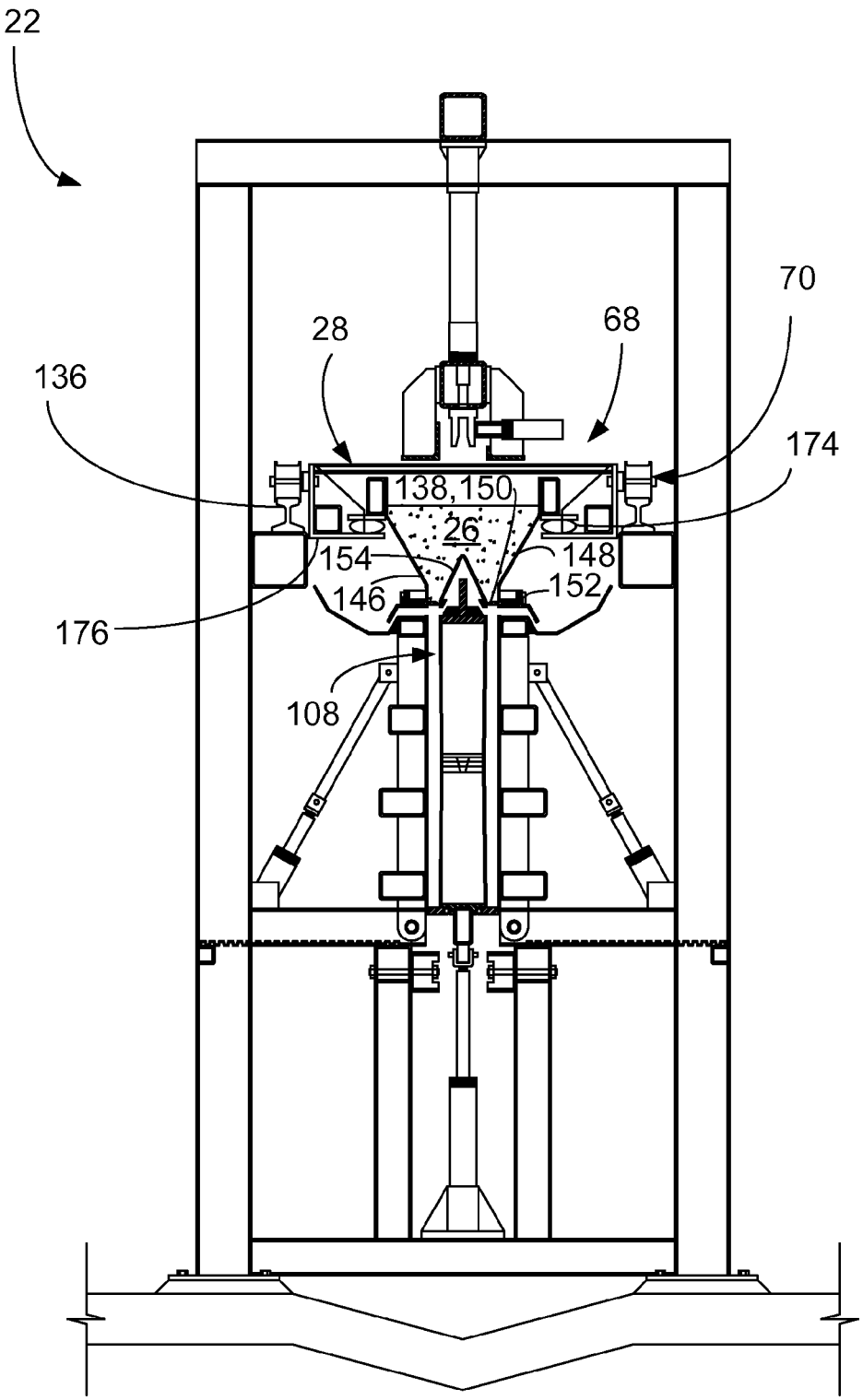
FIGS. 8-19 show cross-sectional views of the casting machine of the present invention in sequential stages of the fabrication process following the first stage shown in FIG. 7.

FIG. 8 shows the next stage of the casting cycle. The concrete mixing system 16 (see also FIGS. 1A and B and FIG. 21) has prepared a batch of concrete 26, and the concrete hopper 68 has moved to the concrete mixer 54 and received the concrete 26. The hopper carriage 70 carrying the concrete hopper 68 then is moved by the hopper carriage mover 72 into alignment with the casting machine 22 and is driven onto the casting machine rails 136 to enter the casting machine 22, and be positioned over the cavity 108 of the casting machine 22.

The concrete hopper assembly 28 is shown and will be discussed in more detail below with regard to FIGS. 20 and 21. However, several features are visible in FIG. 8. These include generally the concrete hopper 68, which is a long trough 146 having sloped sides 148 and a releasable bottom surface 138 preferably having two bottom panels 150 which are openable by hydraulic releasing mechanisms 152. The trough 146 preferably has a triangular central divider 154 which will split the concrete delivery flow into two streams which will exit the hopper 68 through the two opened bottom panels 150 when it is appropriately positioned over the cavity 108 of the casting machine 22.

The concrete hopper 68 is positioned on a hopper carriage 70 and is delivered to the casting machine 22 by a hopper carriage mover 72, preferably by a system of rails, part of which is included in the casting machine 22 as the casting machine rails 136 discussed above. Pneumatic airbags 174 are positioned between portions of the hopper carriage 70 and the concrete hopper 68, as will be discussed in detail below. At this stage, the airbags 174 are inflated so that the concrete hopper 68 is elevated slightly above the casting machine 22.

Figure 9:
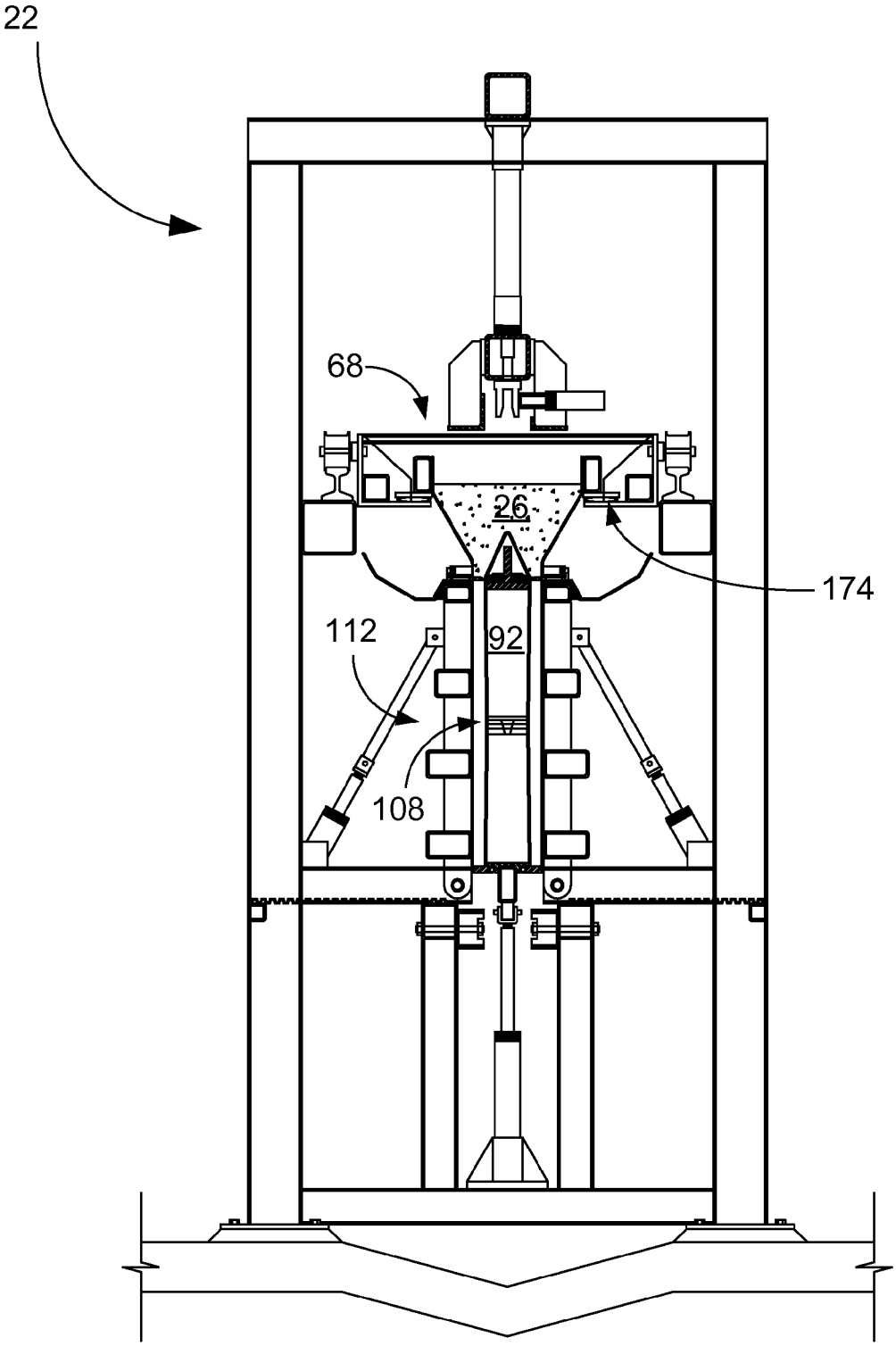

FIG. 9 shows the next stage of the fabrication process. The pneumatic airbags 174 are deflated, so that the concrete hopper 68 lowers onto the self-releasing mold 112, and engages the top core 92 to lock it rigidly into place. The concrete 26 is now ready to be poured into the cavity 108.

Figure 10:
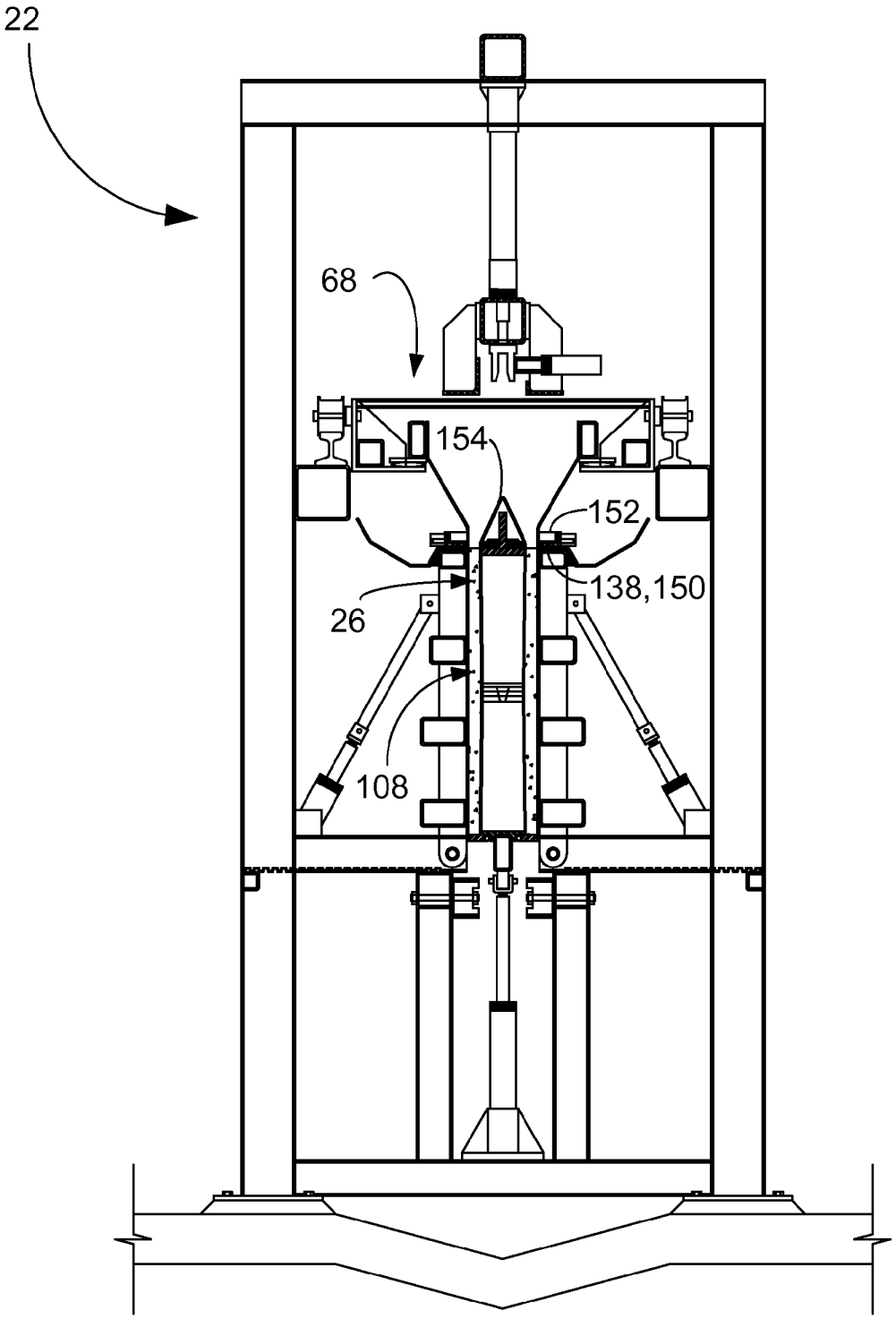

Next, FIG. 10 shows that two bottom panels 150 of the releasable bottom surface 138 have been opened by releasing mechanisms 152. The triangular central divider 154 has split the concrete delivery flow into two streams which have now filled the cavity 108 with concrete 26.

Figure 11:
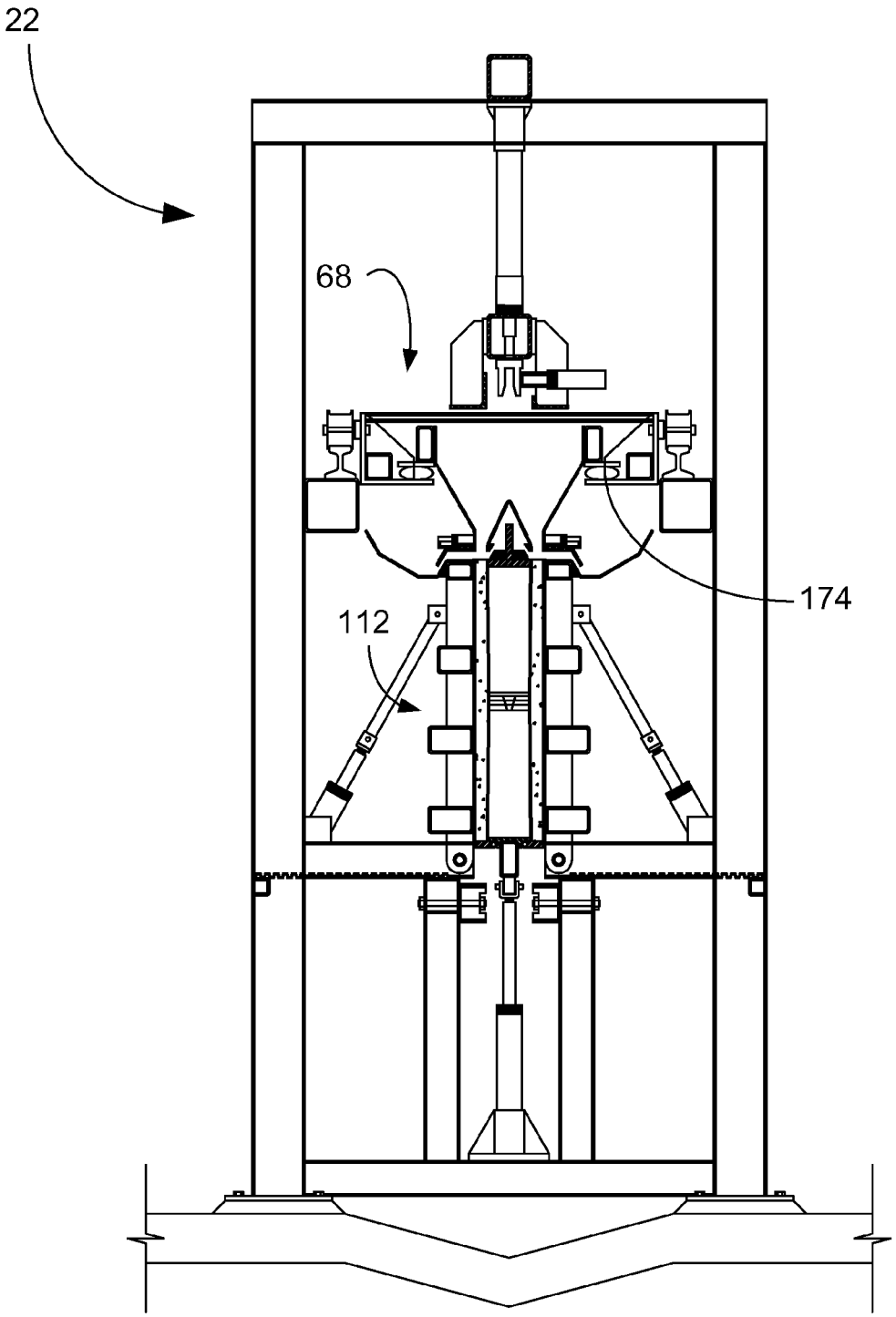
Figure 12:
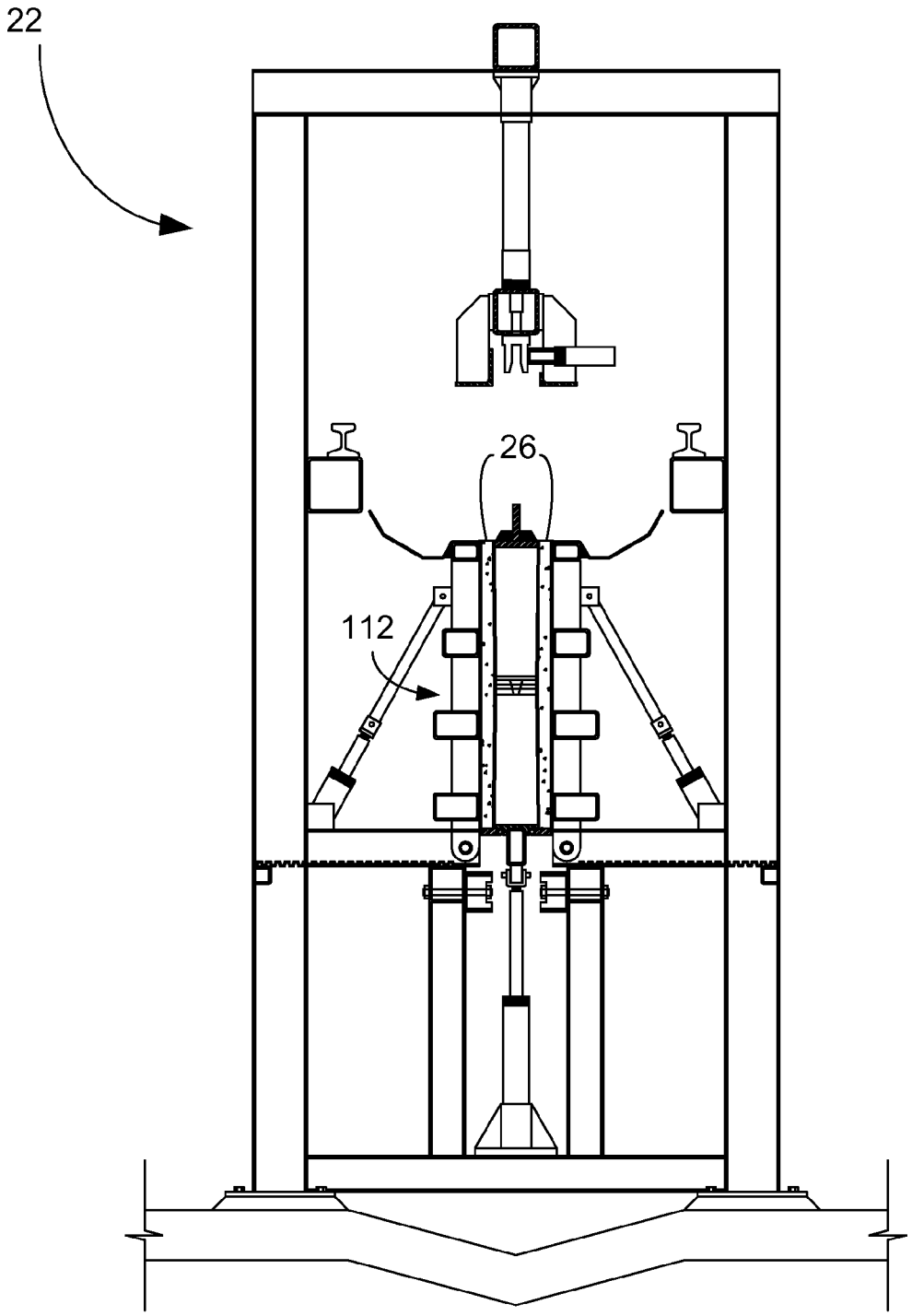

The empty concrete hopper 68 next is raised from the self-releasing mold 112, by re-inflating the pneumatic airbags 174 as shown in FIG. 11, and then exits the casting machine 22, as shown in FIG. 12. The concrete hopper 68 moves to the washout area (see FIGS. 1A and B) and is cleaned while the concrete 26 in the self-releasing mold 112 is vibrated to consolidate it. Vibration helps the concrete 26 to be distributed more evenly and to enter the transverse channels 110 (see FIG. 5) formed in the top and bottom cores which will form the crossweb members 5 pieces of the finished block 1 (see FIG. 2).

In the next stage of fabrication, a screed device (not shown) finishes the top surface of the concrete, and the machine idles until temperature sensors (not shown) signal that the initial concrete set is completed.

Figure 13:
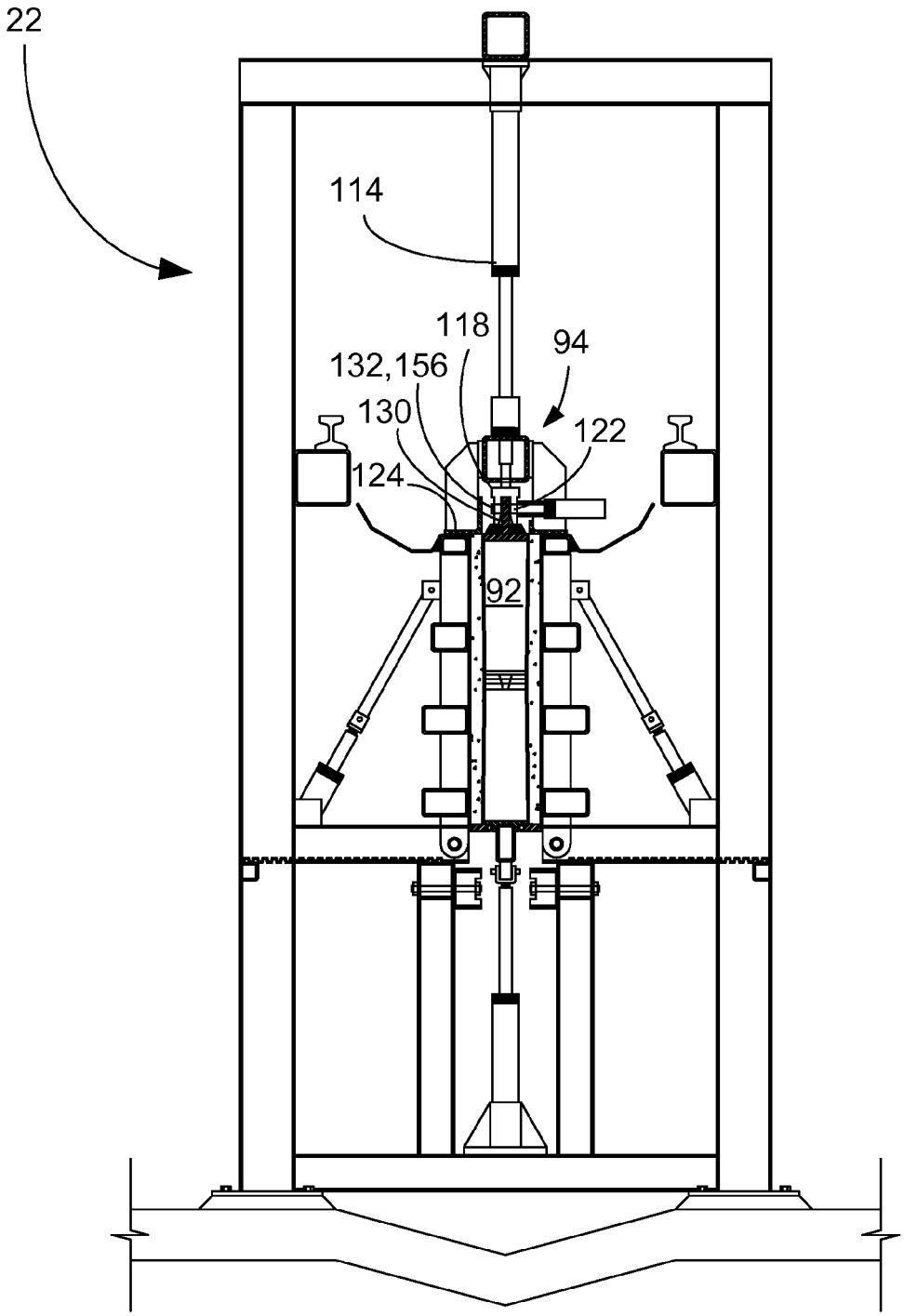

When the initial set is complete, the top core placement assembly 94 is lowered by the core lifter hydraulics 114, as shown in FIG. 13. The slot 132 in the top core collar 118 engages the attachment bracket 130 of the top core 92, and the retaining pin 122 engages the through holes 156 of the attachment bracket 130.

Figure 14:
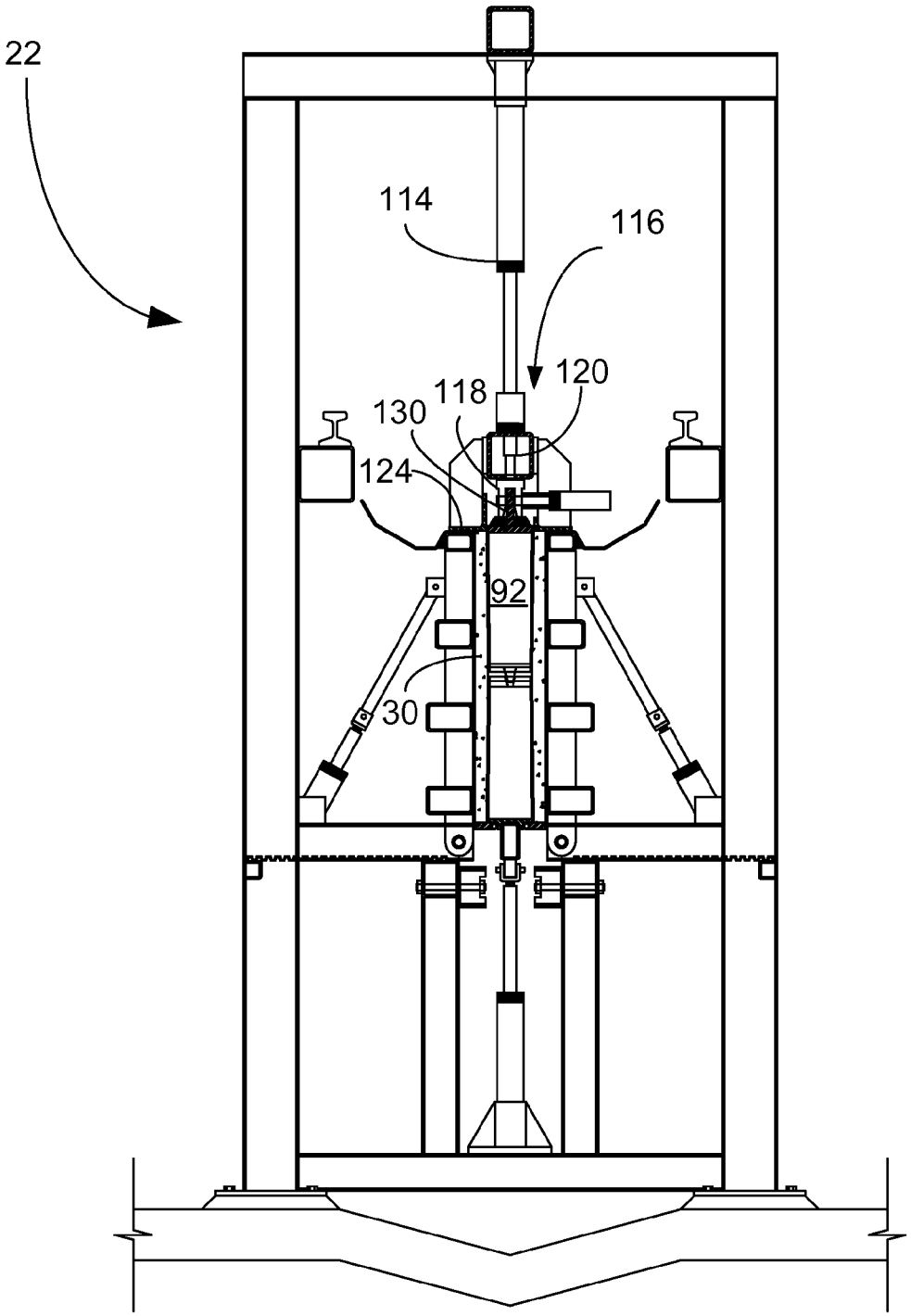

FIG. 14 shows that next the collar extractor hydraulics 120 retract slightly, causing the initial set concrete block 30 to break away from the top core 92, as it is lifted by the attachment bracket 130 and top core collar 118. The flange feet 124 of the top core extractor assembly 116 contact the top surface of the now solid initial set concrete block 30, and prevent it from lifting as the collar extractor hydraulics 120 lift the top core collar 118 with the attached top core 92. The top core 92 is thus pulled gently away from the initial set concrete block 30, which is held down by the flange feet 124. The movement of the collar extractor hydraulics 120 is finely controlled, and releases the top core 92 from the initial set concrete block 30 without tearing the concrete. Although too fine to be shown well in the figures, the profile of the top core 92 has a slight taper preferably of approximately one degree so that the top portion is slightly wider than the bottom, thus aiding in the self-releasing process.

Figure 15:
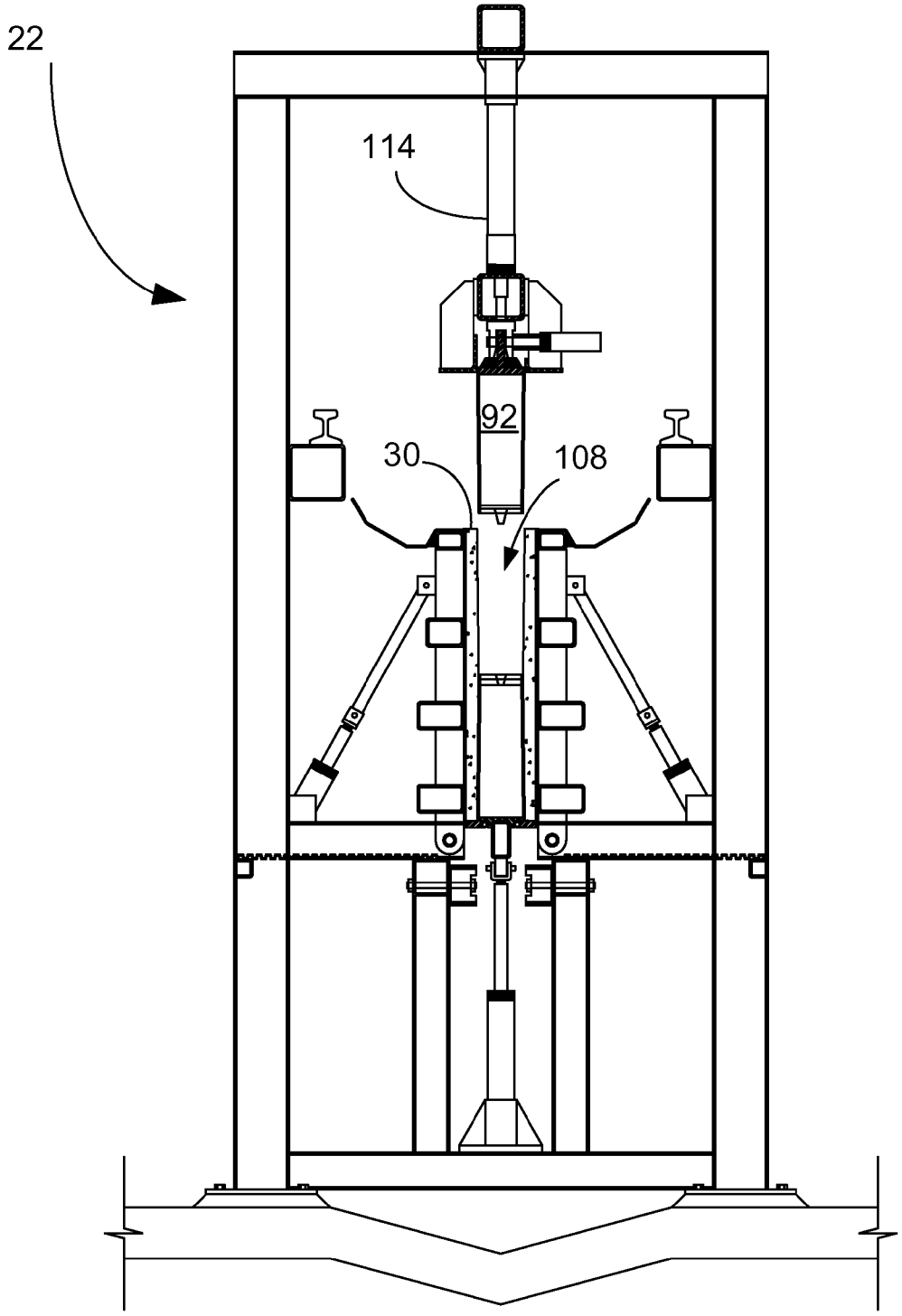

In FIG. 15, it is shown that once the top core 92 has been broken free of the initial set concrete block 30, and is in no danger of tearing the concrete, the core lifter hydraulics 114 are activated to lift the top core 92 out of the cavity 108.

Figure 16:
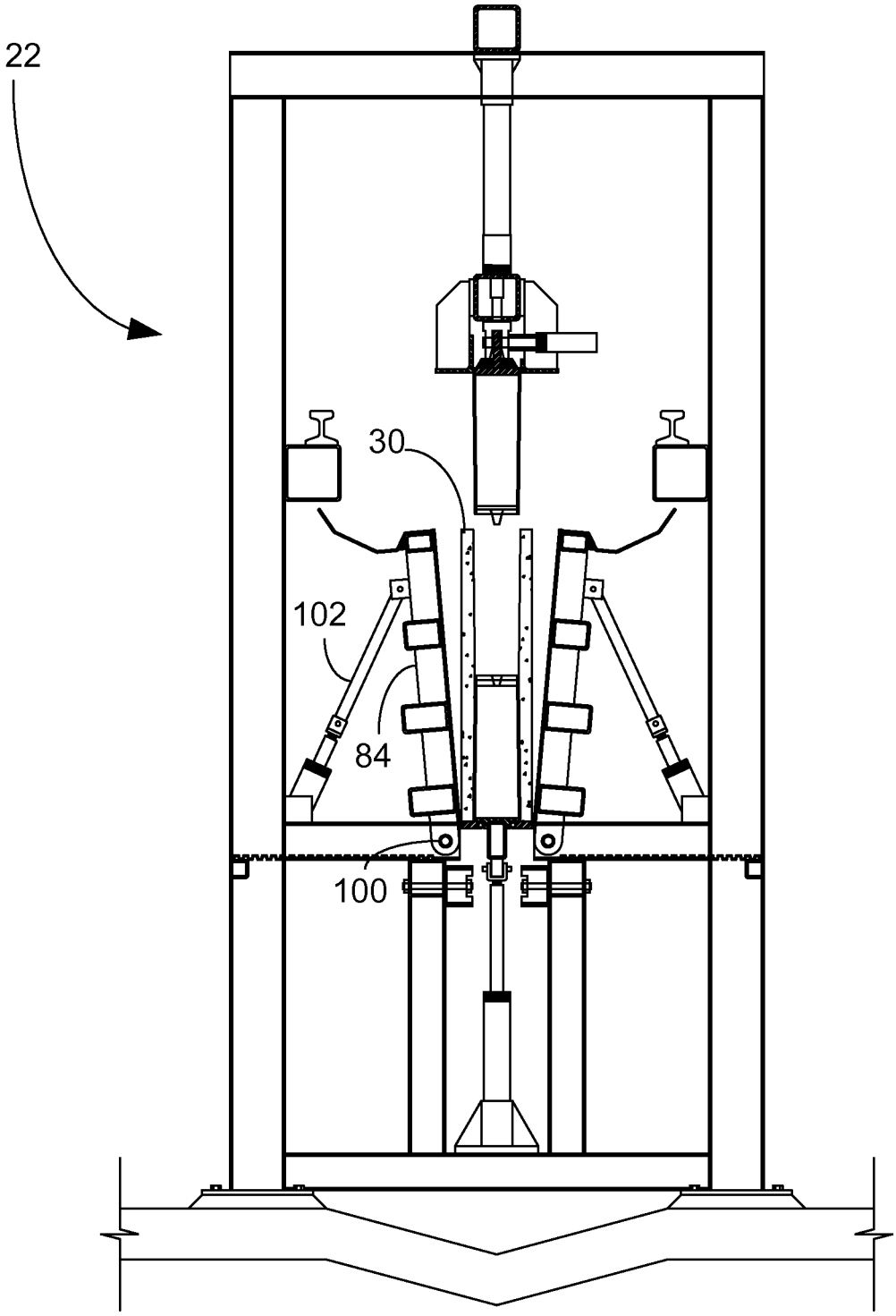

In FIG. 16, the end dams 86 (see FIGS. 5-6) have been pivoted open, and the mold side hydraulics 102 have moved the mold sides 84 to recline, as they pivot on the side pivots 100. The sides of the initial set concrete block 30 are now free.

Figure 17:
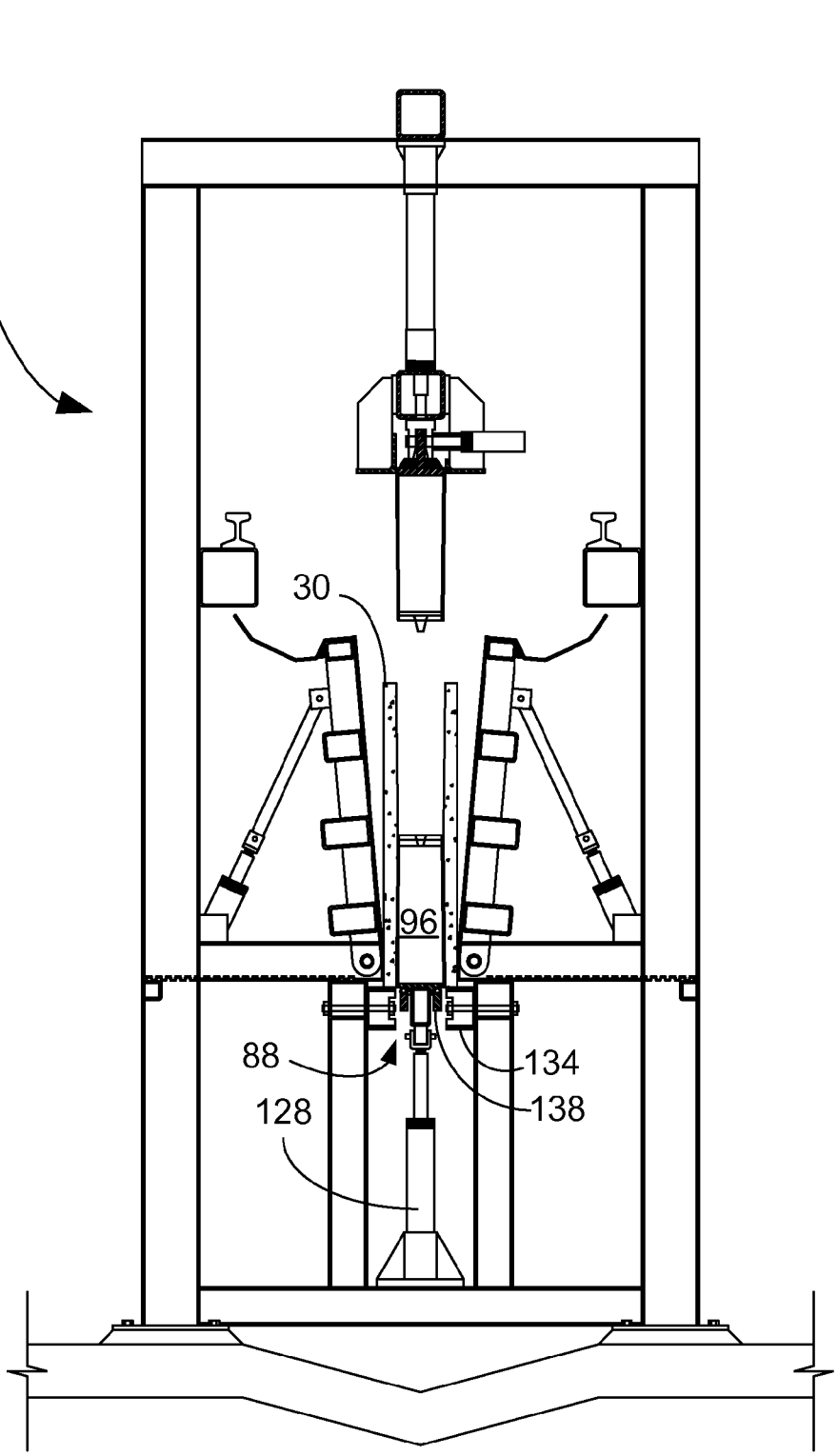

In FIG. 17, bottom surface panels 138 of the bottom casting surfaces 88 have been rotated to vertical, and the bottom core 96, with the initial set concrete block 30, has been lowered by the bottom core vertical hydraulics 128 until the initial set block 30 contacts the block conveyer mechanism 134.

Figure 18:
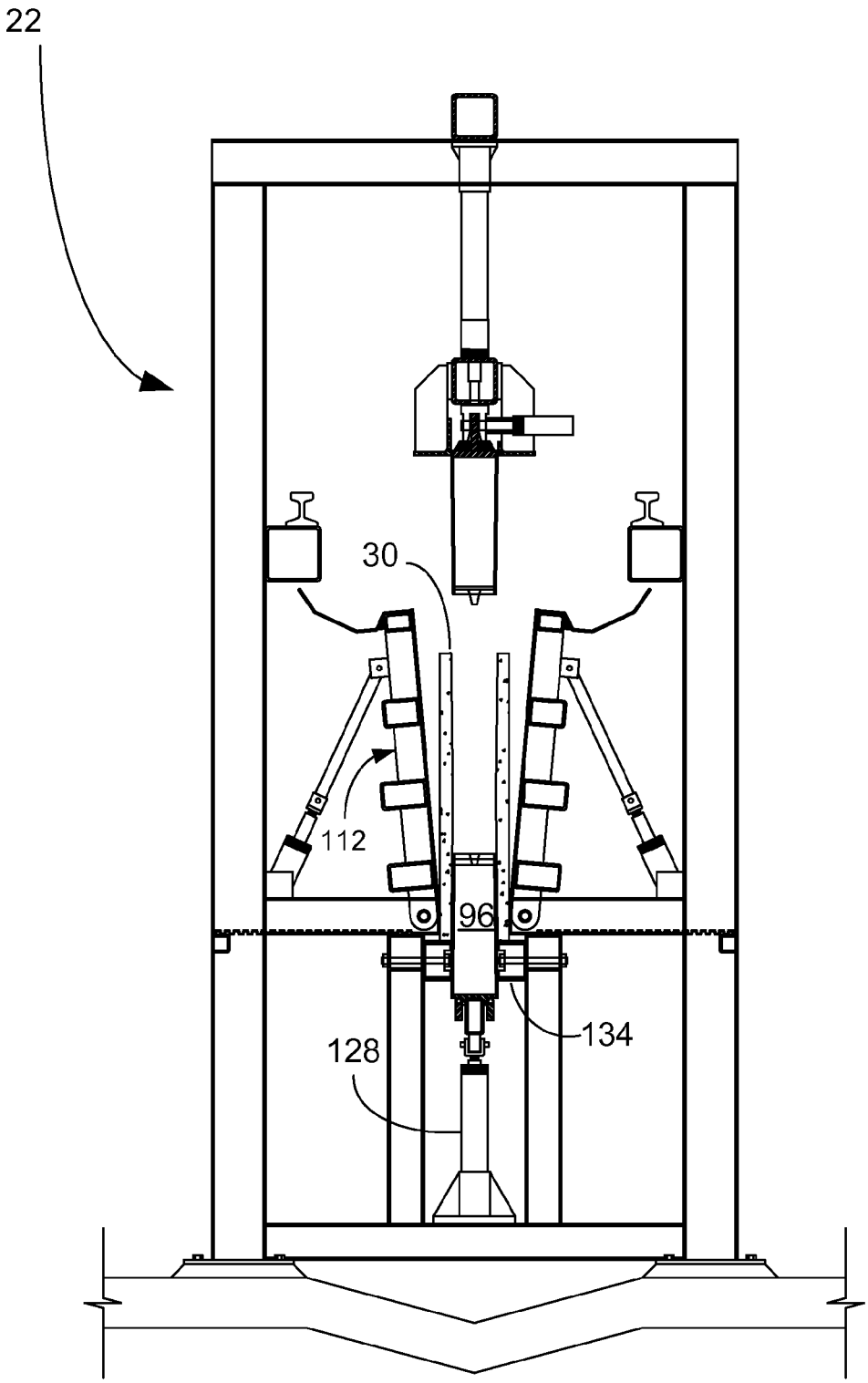

FIG. 18 shows that the bottom core 96 has been retracted even further, until the initial set concrete block 30 has broken free from the bottom core 96 and is entirely supported by the block conveyer mechanism 134. The bottom core vertical hydraulics 128 continue to retract until the bottom core 96 is detached from the initial set concrete block 30, and the initial set concrete block 30 stands free of the casting machine self-releasing mold 112 on the block conveyer mechanism 134. Although too fine to be shown well in the figures, the profile of the bottom core 96 also has a slight taper preferably of approximately one degree so that the bottom portion is slightly wider than the top, thus also aiding in the self-releasing process.

Figure 19:
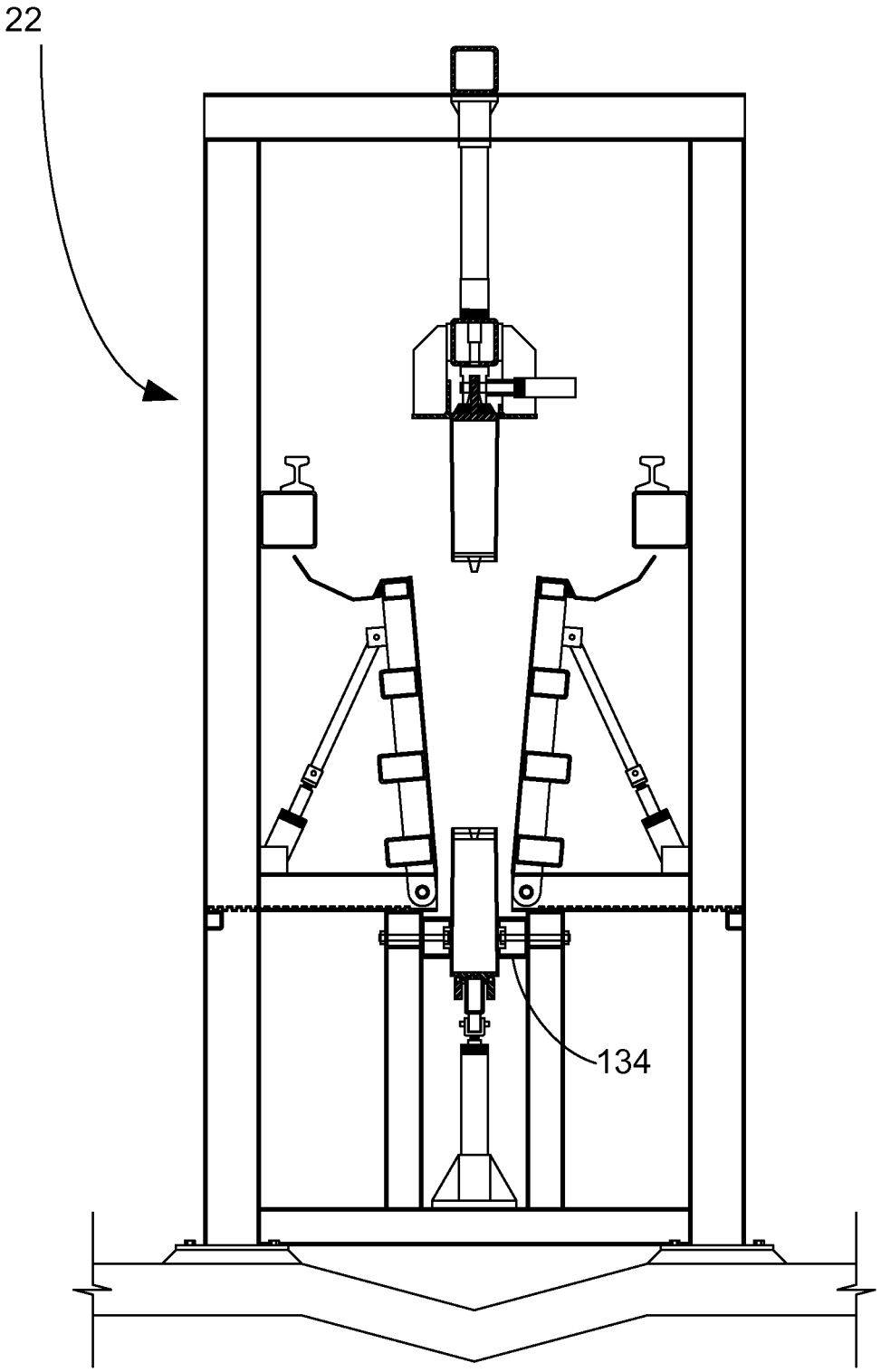

In FIG. 19, the block conveyer mechanism 134 has moved the initial set concrete block 30 (not shown) out of the casting machine 22. The initial set concrete block 30 then enters the initial set heated curing oven 24 (see FIGS. 1A and B), where it hardens further. The casting machine 22 is automatically cleaned with high pressure water spray (not shown) and the surfaces of the casting machine 22 are oiled with release agent spray (not shown). The cycle is ready to start again, and next returns to the stage illustrated in FIG. 7.

From the description of the cycle above, it can be more easily understood what is meant by the term "self-releasing mold", as the movement of the sides, bottom surface, end dams and cores of the mold is completely automated, and requires no human manipulation to remove the solidified block from the casting machine, or for that matter from the entire system. After the block is transported from the casting machine, it is conveyed to curing areas for final hardening, and then further conveyed to a transport area, again all by the automated equipment of the system. Ideally, the system can operate by adding concrete to the input, and receiving finished precast blocks from the output with little or no human manipulation. The plant is meant to be staffed only with inspectors and mechanics who watch the entire process and intervene only for routine maintenance or to halt production when something breaks or malfunctions. This obviously provides great advantages over the prior casting systems which require a great deal of human labor and participation.

Referring again to FIGS. 1A and B, 7 and 20-21, the operation of the casting machines 22 is preferably staggered, so that, for instance, casting machine #1 74 is first placed in closed position, in order to receive concrete mix. The concrete hopper 68, mounted on hopper carriage 70 and hopper carriage mover 72 has been conveyed along transverse rails 62 of the rail system 18 first to the mixed concrete source 16, where it is loaded with mixed concrete, and then is moved along the transverse rails 62 of the rail system 18 as shown in FIG. 1A in a vertical direction, until it is positioned by the hopper carriage mover 72 to enter casting machine #1 74. It then is moved on internal rails 164, (see FIG. 21) of the hopper carriage mover 72, in a direction seen as horizontal in FIGS. 1A and B, until it is fully positioned on the casting machine rails 136, in casting machine #1 74, and delivers the load of concrete into the closed mold of casting machine #1 74. When this operation is completed, the hopper carriage mover 72 withdraws the concrete hopper 68 from casting machine #1 74, and returns along the transverse rails 62 of the concrete delivery subsystem 64 to the concrete mixing system 16 for another load of concrete. It then moves to casting machine #2 76, now in closed position, where it delivers the load of concrete. This pattern continues until all casting machines 22 have been filled in a "complete loading cycle". For the purposes of this patent application, the term "complete loading cycle" will be used to mean the amount of time necessary for the concrete hopper assembly 28 to load all casting machines #1 . . . N, and the solidified block 30 from casting machine #1 74 has completed its initial set stage, and has been removed, so that casting machine #1 74 is ready to receive the next load of concrete.

It is to be understood that the system of sixteen casting machines shown is not to be construed as a limitation. In the preferred embodiment 10, the number of casting machines is chosen so that the initial set time of the concrete coincides with the timing of a complete loading cycle, so that the concrete hopper assembly 28 is in continuous operation. It is also true that the design does not depend on any particular sequence of concrete delivery as described above, or even on all casting machines being in operation. The operation of individual casting machines is mutually independent.

After the block 30 has achieved its initial set stage, and is solid enough to be removed from the casting machine 22, the block 30 is then moved to the initial set heated curing ovens 24, by the block transport system 20, which is preferably a series of automated conveyer belts 66. The temperature of the initial set heated curing ovens 24 is also carefully regulated so that the curing time corresponds to the overall cycle time, and doesn't create a "bottleneck" in the production flow. Typically, this temperature is in the range of 140-180 degrees F. for 8 to 24 hours. The initial cure block 34 is then moved to the final curing area 36 where the final curing stage takes place for typically 28 days before the completed block 1 is moved to a transport area (not shown) for shipping. The length of the conveyer belts 66 of the block transport system 20 is preferably chosen so that a number of blocks 30 can be held without interfering with the timing of the complete loading cycle, referred to above.

An important part of the overall system, which allows for automated operation, is the concrete delivery system 64, portions of which have been partially described above. For purposes of this discussion, the concrete delivery system 64 will include the concrete hopper assembly 28 and the rail system 18 upon which it rides (see FIG. 1). The concrete hopper assembly 28 is shown in an isometric view in FIG. 20 and an exploded isometric view in FIG. 21. The concrete hopper assembly 28 generally includes the concrete hopper 68, the hopper carriage 70 and the hopper carriage mover 72.

Figure 20:
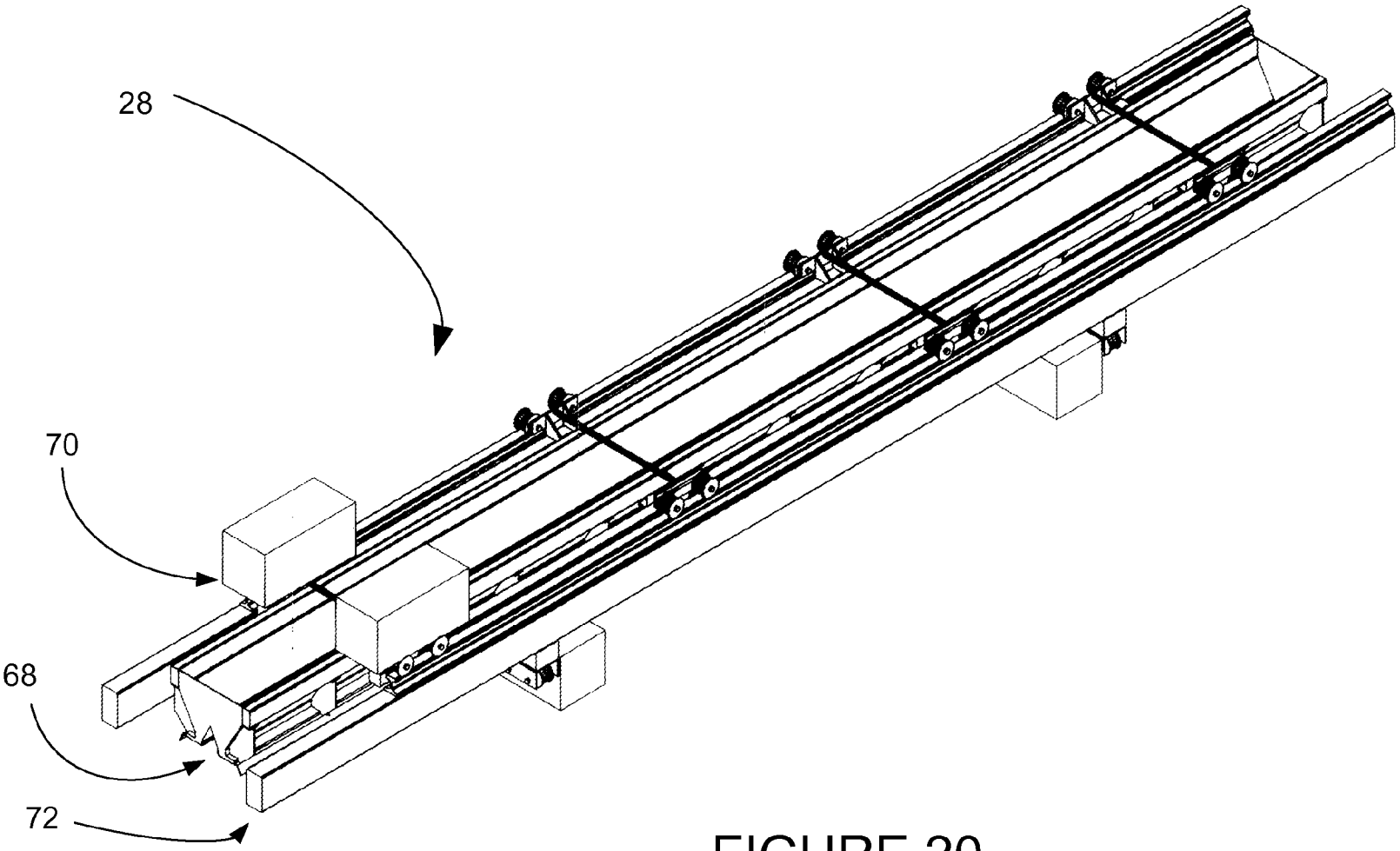
FIG. 20 shows an isometric view of the concrete delivery subsystem of the present invention including the hopper assembly with hopper carriage and hopper carriage mover of the present invention.

As discussed above with reference to FIG. 8, and with continued reference to FIGS. 20-21, the concrete hopper 68 includes a long trough 146 having sloped sides 148 and a releasable bottom surface 138 preferably having two bottom panels 150 which are openable by releasing mechanisms 152. The trough 146 preferably has a triangular central divider 154 which will split the concrete delivery flow into two streams which will exit the hopper 68 through the two opened bottom panels 150 when it is appropriately positioned over the cavity 108 of the casting machine 22.

The concrete hopper 68 rides on the hopper carriage 70 which is formed from carriage frame members 160 fitted with a number of wheel clusters 162. At least one set of wheel clusters 162 is fitted with a set of motor boxes 172, which will drive that set of the wheel clusters 162.

The hopper carriage mover 72 includes a set of internal rails 164 which are attached to primary beams 166. The primary beams 166 are attached to transverse beams 168, which are also preferably attached to transverse wheel clusters 170, and are powered by motor boxes 172.

Referring now also to FIGS. 1A and B, the hopper carriage mover 72 uses the motor boxes 172 to drive the transverse wheel clusters 170 upon the pair of transverse rails 62 to move the whole concrete hopper assembly 28 to the concrete mixing system 16 for filling, and then to align with any of the multiple casting machines 22.

The casting machines include a set of casting machine rails 136 (see also FIG. 7), and the hopper carriage mover 72 moves until its set of internal rails 164 are aligned with these casting machine rails 136. The hopper carriage mover 72 then stops, and the motor boxes 172 of the hopper carriage 70 then drive the wheel clusters 162 to move upon the internal rails 164 of the hopper carriage mover 72 and to carry the concrete hopper 68 into position above the cavity 108 of the casting machine 22. Pneumatic airbags 174 on the frame 176 of the wheel clusters 172 are inflated when the concrete hopper 68 is being moved above the casting machine (see also FIG. 8), and are deflated to lower the concrete hopper 68 onto the casting machine 22 (see FIG. 9). The concrete 26 is released into the cavity 108 of the casting machine 22, as described above. The airbags 174 then re-inflate to raise the concrete hopper 68, and the hopper carriage 70 drives from the casting machine rails 136 onto the internal rails 164 of the hopper carriage mover 72 again. The hopper carriage mover 72 then drives on the transverse rails 62 back to the concrete mixing system 16, is filled, and proceeds to the next casting machine 76. This cycle repeats until all casting machines 22 have been filled, at which time, the first casting machine 74 to be filled is preferably through with its casting cycle, has ejected its initial set concrete block 30 and is ready to be filled again.

Thus to describe the general operation of the concrete delivery subsystem 64 in simple terms, in reference to the orientation of FIGS. 1A and B, the hopper carriage mover 72 generally moves the concrete hopper 68 and hopper carriage 70 in a vertical direction, and the hopper carriage 70 then moves the concrete hopper 68 horizontally.

Figure 22:
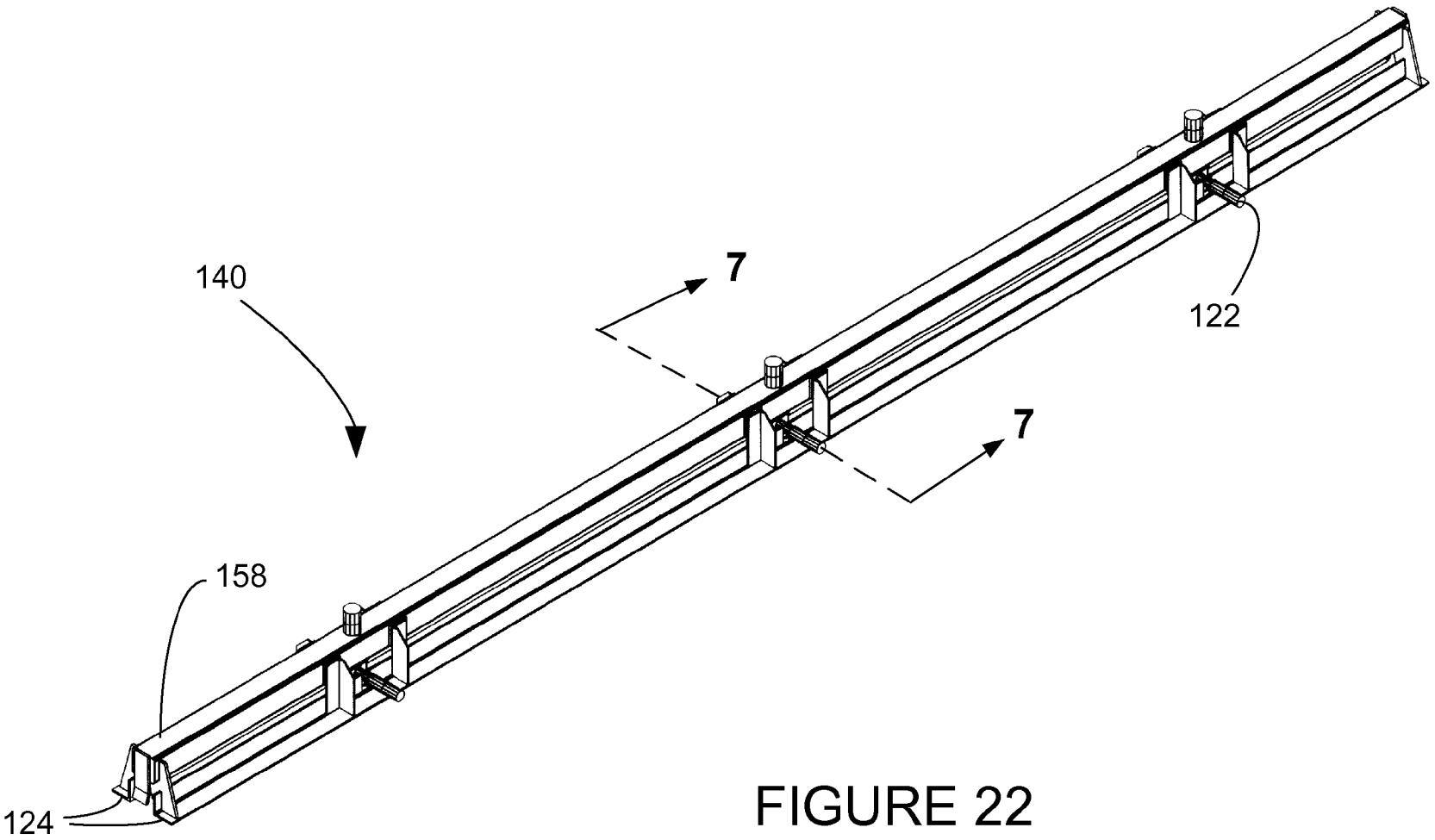
FIG. 22 shows an isometric view of the core lifter of the present invention.

FIG. 22 shows an isometric view of the core lifter subassembly 140, of which a cross-sectional view 7-7 is included as part of FIG. 7, which is referred to now also. The core lifter subassembly 140 includes the housing 158, collar flange feet 124, top core collar 118 having slot 132, retaining pins 122, and extractor hydraulics 114. The core lifter subassembly 140 is included as part of the top core extractor assembly 116, and this assembly is also involved in the placement of the top core 92, and thus is also properly referred to as part of the top core placement assembly 94. As described above, the core lifter subassembly 140 is raised and lowered by core lifter hydraulics 114. When lowered, slot 132 engages the attachment bracket 130 of the top core 92 and retaining pins 122 engage through holes (not visible) on the top core attachment bracket 130. The top core 92 can thus be lifted by retraction of the top core lifter hydraulics 114. Also as described above, the collar extractor hydraulics 120 are used to pull the top core 92 from the initial set concrete block as part of the self-releasing operation of the casting machine 22.

Figure 23:
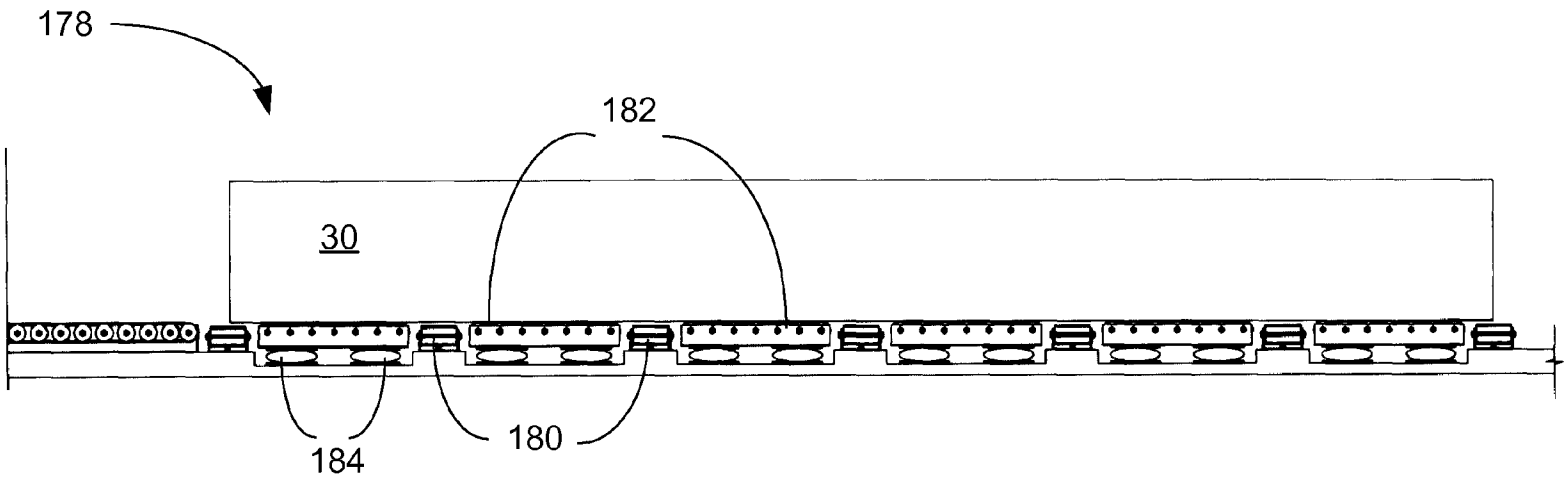
FIGS. 23-24 are side plan views of the lateral to transverse conveyer subsystem of the present invention.
Figure 24:
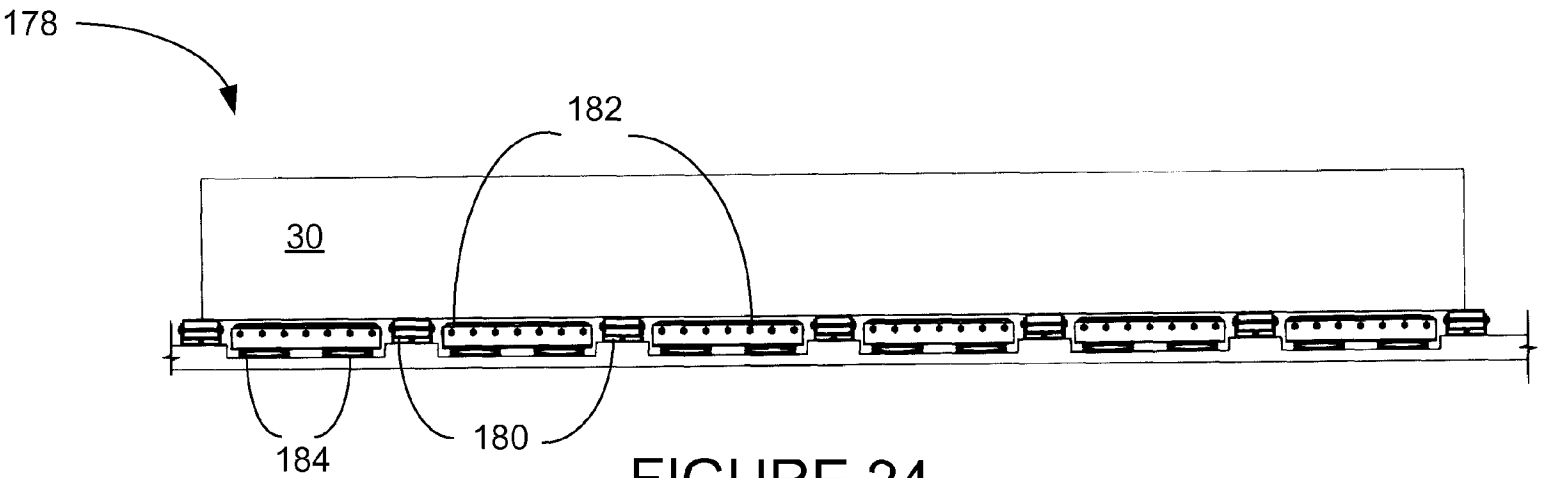

Another aspect of the system 10, which allows the automated routing of the initial set blocks 30, is the lateral to transverse conveyer subsystem 178, which can be seen in the right-hand portion of FIG. 1A, and in FIGS. 23 and 24. For purposes of this discussion and referring to the orientation of FIG. 1A, the left-to-right movement of the blocks will be referred to as "lateral" and movement from top of the page to bottom, or vice-versa, will be referred to as "transverse". The initial cure blocks 30 emerge from the casting machines 22 along the conveyer belts 66 in a direction which is laterally to the right in FIG. 1A. Although it is not a requirement, for design considerations of the production plant 12, it may be desired that the curing ovens 24 be located transversely from the lateral conveyer belts 66 emerging from the casting machines 22. Thus the blocks 30 must be made to travel at right angles to their initial lateral direction to reach the curing ovens 24. To accomplish this, a number of transverse conveyers 180 are provided which are interspersed with the lateral conveyers 66, which in the area of the lateral to transverse conveyer subsystem 178, are reduced in length, and will be referred to as reduced lateral conveyers 182. Obviously, if both the transverse conveyers 180 and reduced lateral conveyers 182, each running at right angles to each other, were to contact the initial set blocks 30 at the same time, the blocks would spin or tip over, causing a pile-up of blocks. Therefore, the lateral to transverse conveyer subsystem 178 is designed so that the blocks 30 are moved by either the transverse conveyers 180 or reduced lateral conveyers 182, but not both at the same time.

This is accomplished by the system illustrated in more detail in FIGS. 23 and 24, which are side views of an initial set block 30 being moved by the lateral to transverse conveyer subsystem 178 from a lateral direction in FIG. 23 to a transverse direction in FIG. 24. In FIG. 23 the block 30 is supported by a number of reduced lateral conveyers 182. Interspersed with the reduced lateral conveyers 182 are the transverse conveyers 180. The reduced lateral conveyers 182 include pneumatic air bags 184, which are similar to the pneumatic air bags included in the concrete hopper assembly 28 discussed above. These pneumatic air bags 184 are currently inflated in FIG. 23, so that the conveying surfaces of reduced lateral conveyers 182 are higher than those of the transverse conveyers 180. The block 30 thus only contacts the reduced lateral conveyers 182 and is moved only in a lateral direction.

FIG. 24 shows the effect of deflating the pneumatic air bags 184, so that now the block 30 rests on the transverse conveyers 180. The block 30 can now be moved in a transverse direction into the curing ovens 24 (see FIG. 1A).

It should be understood that number and placement of the transverse conveyers 180 and the reduced lateral conveyers 182 is not limited to those shown in FIG. 1A. In fact, the transverse conveyers 180 are shown more closely spaced near the top right corner of FIG. 1A than near the bottom of this figure. The closer spacing allows blocks of shorter lengths to be manipulated, while the wider spacing may be sufficient for longer blocks. It should also be understood that a lateral to transverse conveyer subsystem may not be required at all in the instance of a plant which has enough continuous length that the curing ovens may be fed by the lateral conveyers directly, without the necessity of making a turn in the production flow. However, the option of using a lateral to transverse conveyer subsystem allows more flexibility in the selection of plant sites and production design.

Figure 25:
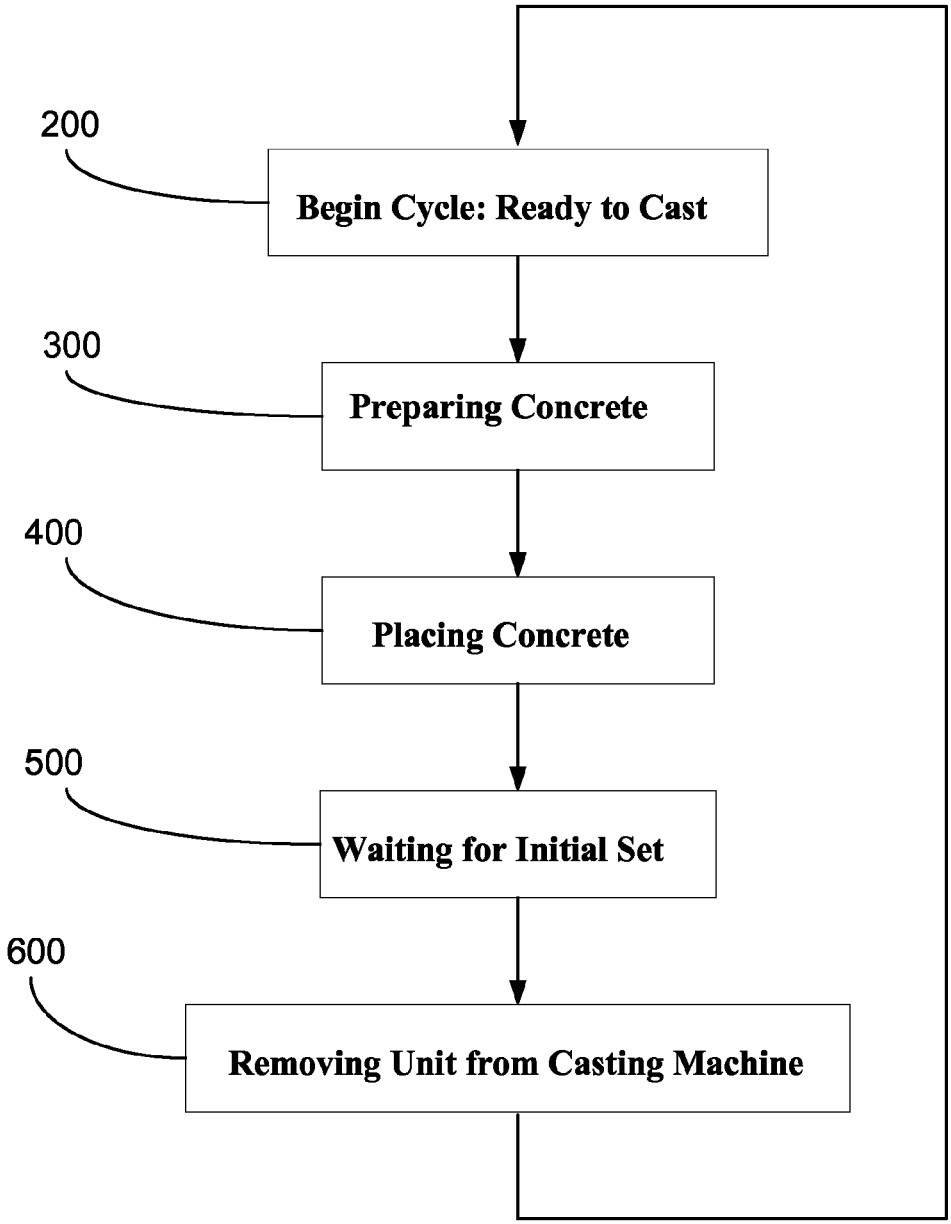
FIGS. 25-30 are flow charts showing the stages in the fabrication of a structural member as manufactured by the system of the present invention.

The production cycle using the modular precasting system of the present invention is summarized with reference to flowcharts seen in FIGS. 25-30. Referring to FIG. 25, the basic major stages of the manufacturing process are shown. These include Begin Cycle: Ready to Cast 200, Preparing Concrete 300, Placing Concrete 400, Waiting for Initial Set 500, and Removing Block from Casting Machine 600. The cycle is then repeated to produce the next block.

Figure 26:
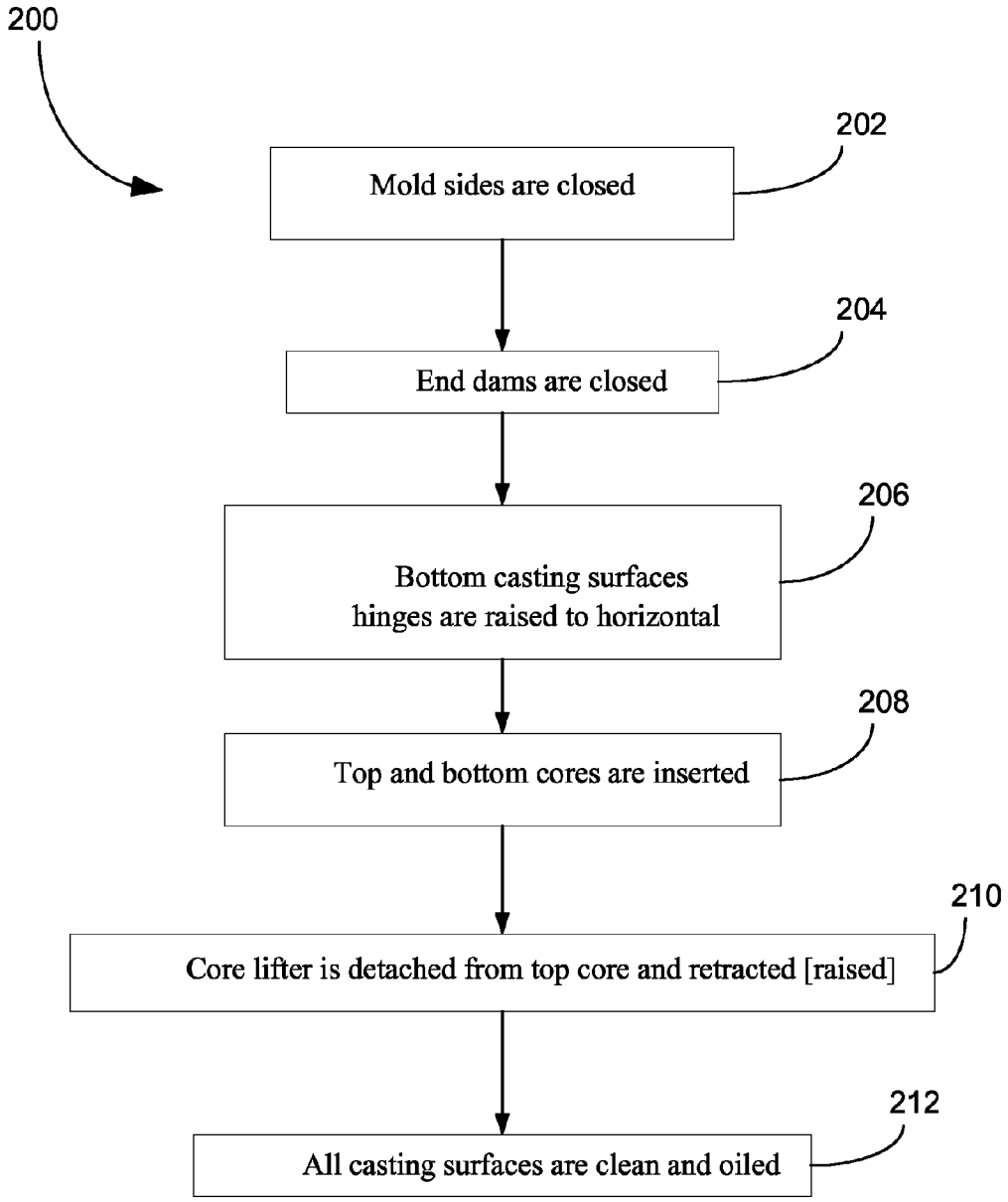

As seen in FIG. 26, the stages within the first major stage, Begin Cycle: Ready to Cast 200, are:

Mold sides are closed 202;

End dams are closed 204;

Bottom casting surfaces hinges are raised to horizontal 206;

Top and bottom cores are inserted 208;

Core lifter is detached from top core and raised 210; and

All casting surfaces are clean and oiled 212.

Figure 27:
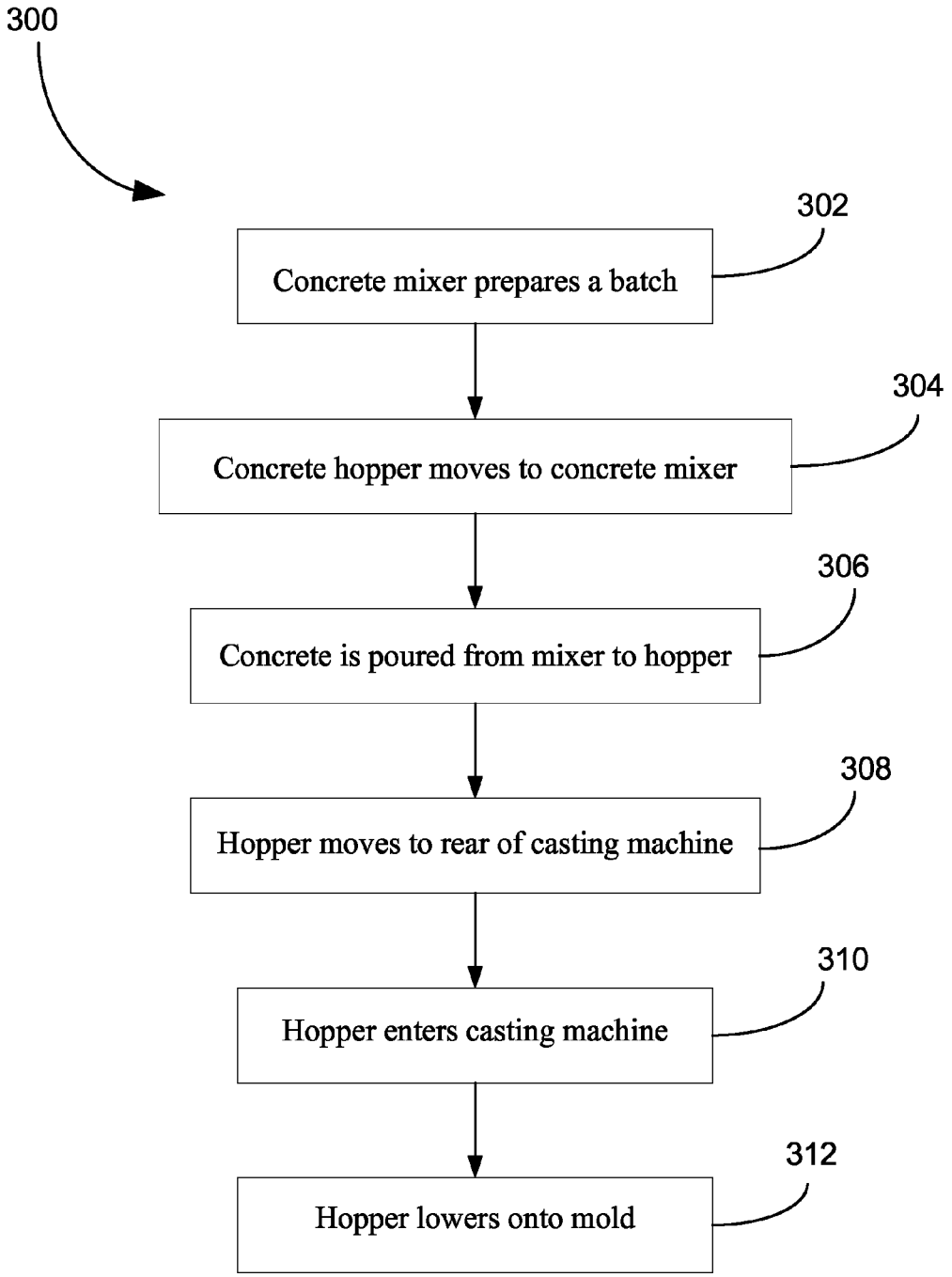

As seen in FIG. 27, the stages within the second major stage, Preparing Concrete 300, are:

Concrete mixer prepares a batch 302;

Concrete hopper moves to concrete mixer 304;

Concrete is poured from mixer to hopper 306;

Hopper moves to rear of casting machine 308;

Hopper enters casting machine 310; and

Hopper lowers onto mold 312.

Figure 28:
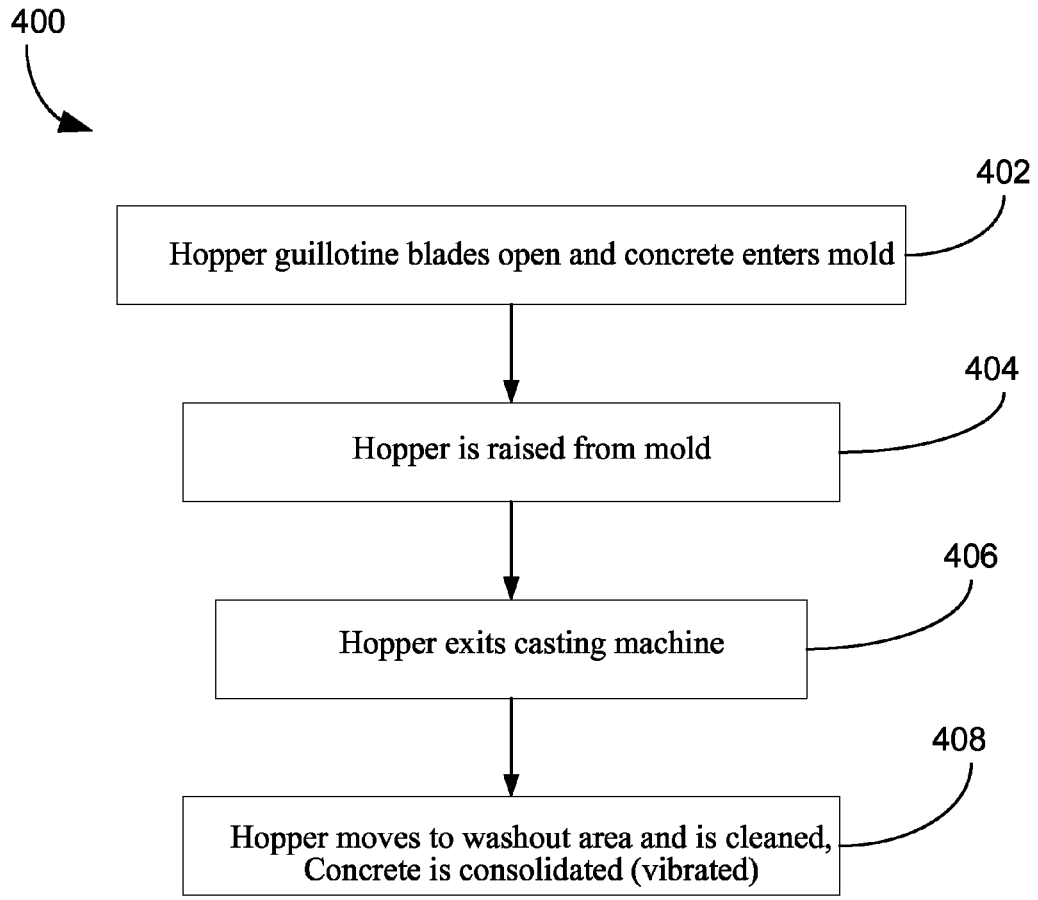

The stages within the third major stage, Placing Concrete 400, as seen in FIG. 28 are:

Hopper guillotine blades open and concrete enters mold 402;

Hopper is raised from mold 404;

Hopper exits casting machine 406; and

Hopper moves to washout area and is cleaned, while concrete is consolidated (vibrated) 408.

Figure 29:
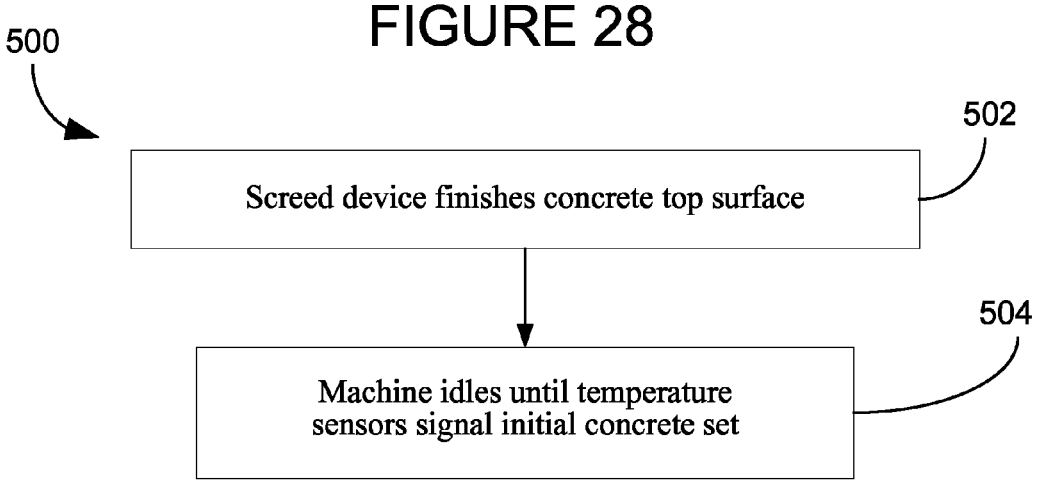

As seen in FIG. 29, the stages within the fourth major stage, Waiting for Initial Set 500, are:

Screed device finishes concrete top surface 502; and

Machine idles until temperature sensors signal initial concrete set 504.

Figure 30:
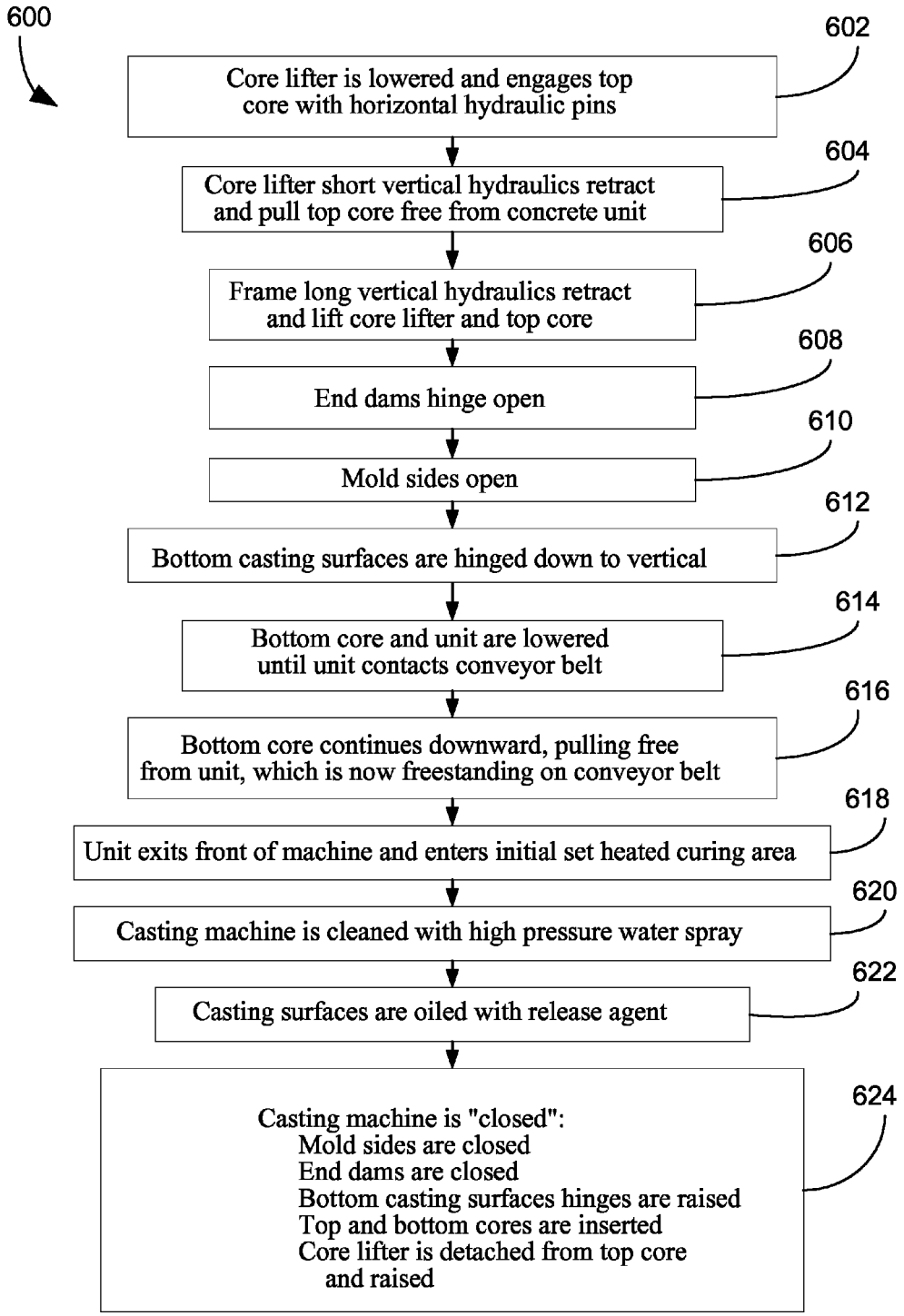

As seen in FIG. 30, the stages within the fifth major stage, Removing Block from Casting Machine 600 are:

Core lifter is lowered and engages top core with horizontal hydraulic pins 602;

Core lifter short vertical hydraulics retract and pull top core free from concrete block 604;

Frame long vertical hydraulics retract and lift core lifter and top core 606;

End dams hinge open 608;

Mold sides open 610;

Bottom casting surfaces are hinged down to vertical 612;

Bottom core and block are lowered until block contacts conveyor belt 614;

Bottom core continues downward, pulling free from block, which is now freestanding on conveyor belt 616;

Block exits front of machine and enters initial set heated curing area 618;

Casting machine is cleaned with high pressure water spray 620;

Casting surfaces are oiled with release agent 622;

Casting machine is "closed":

Mold sides are closed,

End dams are closed,

Bottom casting surfaces hinges are raised,

Top and bottom cores are inserted,

Core lifter is detached from top core and raised 624.

While various embodiments have been described above, it should be understood that they have been presented by way of example only, and not limitation. Thus, the breadth and scope of a preferred embodiment should not be limited by any of the above described exemplary embodiments, but should be defined only in accordance with the appended claims and their equivalents.

INDUSTRIAL APPLICABILITY

The present system for fabrication of precast modular blocks 10 is well suited for application in building construction of many kinds. The use of large-scale precast blocks 1 can greatly increase the speed with which buildings can be erected, and can reduce the amount of human labor required. The system of the present invention 10 provides an automated system for the fabrication of precast modular blocks for building construction which is highly efficient and allows the production of much greater numbers of precast modular blocks of a larger size than is possible by use of prior casting equipment and methods.

The present invention includes a system for manufacture of precast concrete structural members 10 which includes a production plant 12 housing the system 10, which includes at least one casting machine 22, a concrete delivery subsystem 64, and a block transport subsystem 20. The casting machines 22 are themselves novel, as they include self-releasing molds 112, by which the components of the mold remove themselves from contact with the solid initial set concrete blocks 30 automatically. These components are powered by hydraulic or other mechanical mechanisms, which can be operated without human action, thus greatly reducing the labor and cost of the finished units.

Generally, wet concrete is prepared in a concrete mixing system 16, and poured into the concrete hopper 68 which is mounted to the hopper carriage 70, and moved in position with one of the casting machines 22 by the hopper carriage mover 72. When the casting machine 22 is in closed position 80, the mold sides 84, mold end dams 86, and bottom casting surface 88 surround a cavity 108 into which the wet concrete will be poured. The mold sides 84, mold end dams 86, and bottom casting surface 88, as well as the top core 92 and bottom core 96 together form the self-releasing mold 112. Concrete is poured into this self-releasing mold 112 and hardens to its initial set stage while in the casting machine 22.

Then the casting machine 22 moves to an open configuration 78, during which the newly cast block 30 is freed from the mold 112 of the casting machine 22 and the top core 92 and bottom core 96. The top core placement assembly 94 includes core lifter hydraulics 114 and a core extractor 116, which has a top core collar 118 and collar extractor hydraulics 120 and retaining pin 122. The top core extractor 116 is designed to gently pull up on the top core 92, while pushing down on the tops of the cast block 30, so that the top core 92 is removed from the initial set block 30 without tearing the newly set concrete. The mold sides 84, and mold end dams 86 are then moved away from the cast block 30 so that the sides and ends are free. Lastly, bottom surface panels 150 of the releasable bottom casting surface 88 rotate on bottom surface pivots 126, and the bottom core 96 is drawn downwards by the bottom core vertical hydraulics 128. The cast block 30 contacts the block conveyer mechanism 134, which stops the downward movement of the block 30, while the bottom core 96 continues downwards until it is free from contact with the block 30. The block 30 has now been released from the casting machine 22 by the machine's self-releasing operation.

The block 30 is then moved to the initial set heated curing ovens 24, preferably by a system of conveyer mechanisms 66 which are included in the block transport system 20. After an initial heated cure operation, the block 30 is then moved to the final curing area 36 where the final curing stage takes place before the completed block 1 is moved to a transport area for shipping.

The system 10 is preferably designed with multiple casting machines 22, which are all served by a single concrete hopper assembly 28. The concrete hopper 68, mounted on hopper carriage 70, is conveyed first to the concrete mixing source 16, loaded with mixed concrete 26, and then is moved along the rails 18 of the concrete delivery subsystem 64 until it is positioned by the hopper carriage mover 72 to enter the first casting machine 74. It then is moved until it is fully positioned in the first casting machine 74, and delivers the load of wet concrete 26 into the closed mold of the first casting machine 74. When this operation is completed, the hopper carriage mover 72 withdraws the concrete hopper 68 from the first casting machine 74, and returns along the rails of the concrete delivery subsystem 64 to the concrete mixing source 16 for another load of concrete. It then moves to the second casting machine 76, now in closed position, where it delivers the load of concrete. This pattern continues until all casting machines 22 have been filled. Preferably, the number of casting machines 22 is chosen so that the concrete hopper assembly 28 is in continuous operation.

The self-releasing operation of the casting machines 22 allows the system 10 to function with a minimum of human intervention. Ideally, the system 10 can be operated automatically so that mixed concrete 26 is introduced at the input and finished precast blocks 1 can be collected from the output. This greatly reduces the labor required and cost of the finished units. This highly efficient system allows the production of much greater numbers of precast modular blocks of a larger size than is possible by use of prior casting equipment and methods.

For the above, and other, reasons, it is expected that the system 10 of the present invention will have widespread industrial applicability. Therefore, it is expected that the commercial utility of the present invention will be extensive and long lasting.

What is claimed is:

1. A method of fabrication for precast concrete structural members, said method comprising:

A) providing an automated concrete structural member fabrication system, including at least one casting machine having a self-releasing mold which includes side walls and end dams which are pivotally movable from an open position to a closed position, and a bottom casting surface, where said bottom casting surface includes pivotable bottom surfaces which rotate on bottom surface pivots to a vertical position and to a horizontal position, said bottom casting surface, said side walls, and said end dams serving to form a self-releasing mold surrounding a cavity when said side walls and said end dams are in said closed position, said self-releasing mold being configured to contain wet concrete which is poured into said cavity, said side walls, and said end dams being automatically movable to an open position when said concrete has solidified so that a precast concrete structural member is automatically released from said self-releasing mold; and a removable bottom core which completely supports a precast structural member from within when said side walls and said end dams are moved to said open position;

B) moving said mold sides, said mold end dams and said bottom casting surfaces to a closed position;

C) positioning said removable bottom core within said cavity;

D) filling said cavity with wet concrete;

E) idling said casting machine until said wet concrete has achieved initial set to form an initial set concrete block;

F) automatically releasing said self-releasing mold from said initial set concrete block; and G) removing said initial set concrete block from said casting machine.

2. The method of fabrication of claim 1, wherein said automated concrete structural member fabrication system of A further comprises a concrete mixing system, and a concrete delivery subsystem, which includes a concrete hopper assembly, and a rail system.

3. The method of fabrication of claim 2, wherein D comprises:

a) loading said concrete hopper assembly with wet concrete from said concrete mixing system;

b) conveying said concrete hopper assembly to said casting machine; and c) automatically dispensing said wet concrete from said concrete hopper assembly into said cavity of said casting machine.

4. The method of fabrication of claim 1, wherein said automated concrete structural member fabrication system of A further comprises a top core extractor assembly and a bottom core extractor assembly.

5. The method of fabrication of claim 4 wherein F comprises:

a) moving said side walls and said end dams to an open position;

b) extracting said top core by use of said top core extractor assembly; and c) extracting said bottom core by use of said bottom core extractor assembly.

6. The method of fabrication of claim 1 wherein said automated concrete structural member fabrication system further comprises a block transport system including conveyer belts included in said casting machine.

7. The method of fabrication of claim 6 wherein G comprises:

a) placing said initial set concrete block on said conveyer belts included in said casting machine; and b) conveying them from within said casting machine.

8. The method of fabrication of claim 1, wherein said automated concrete structural member fabrication system of A further comprises a final curing area.

9. The method of fabrication of claim 8 further comprising:

H) curing said initial set concrete block in said final curing area.

* * * * *